US007506690B2

(12) United States Patent
Kelley

(10) Patent No.: US 7,506,690 B2
(45) Date of Patent: Mar. 24, 2009

(54) ENHANCED LIQUID HYDROCARBON RECOVERY BY MISCIBLE GAS INJECTION WATER DRIVE

(76) Inventor: Terry Earl Kelley, 2738 MLK Jr. Way, Berkeley, CA (US) 94703

( * ) Notice: Subject to any disclaimer, the term of this patent is extended or adjusted under 35 U.S.C. 154(b) by 340 days.

(21) Appl. No.: 11/408,413

(22) Filed: Apr. 21, 2006

(65) Prior Publication Data

US 2007/0000663 A1 Jan. 4, 2007

Related U.S. Application Data

(63) Continuation-in-part of application No. 10/340,818, filed on Jan. 9, 2003, now abandoned.

(60) Provisional application No. 60/393,515, filed on Jul. 5, 2002, provisional application No. 60/346,311, filed on Jan. 9, 2002.

(51) Int. Cl.
*E21B 43/16* (2006.01)

(52) U.S. Cl. ..... 166/372; 166/370; 166/106

(58) Field of Classification Search ..... 166/370, 166/372, 105.5, 106
See application file for complete search history.

(56) References Cited

U.S. PATENT DOCUMENTS 6,101,447 A * 8/2000 Poe, Jr. ..... 702/13
RE38,616 E * 10/2004 Gondouin ..... 166/380
2005/0199391 A1* 9/2005 Cudmore et al. ..... 166/250.15
2007/0162235 A1* 7/2007 Zhan et al. ..... 702/6

* cited by examiner

*Primary Examiner*—Shane Bomar
(74) *Attorney, Agent, or Firm*—Baker Botts LLP.; Chris W. Kennerty; Travis W. Thomas

(57) ABSTRACT

In distinct embodiments, miscible gas is injected directly into crude oil within its formation, entering into solution within it at optimum pressures, adding desired solution gas saturation, increasing its mobility and fluidity. This mobile solution gas saturated oil is produced by controlled wellbore to formation pressures maintained above its critical bubble point pressure, from same injection wells converted into oil recovery wells, where liquids only are differential pressure injected through invention's improved Liquid Injector DOLI, into the production tubing, while maintaining gas volume, pressure, and solution gas saturation in the formation, for total in place oil recovery.

Injected down structure water drive pressure WDP into crude oil or gas formations augments recovery.

Completely effective gas well De-liquefying is attained by flowing gas recovery up the wellbore annulus dry, while producing all liquids separately through the liquid Injector into the production tubing, to be plunger lifted to surface with gas lift.

24 Claims, 13 Drawing Sheets

ENHANCED LIQUID HYDROCARBON RECOVERY BY MISCIBLE GAS INJECTION WATER DRIVE

RELATED APPLICATIONS

This application is a continuation-in-part, under 35 U.S.C. § 120, of U.S. patent application Ser. No. 10/340,818, filed 9 Jan. 2003 now abandoned. U.S. patent application Ser. No. 10/340,818 claims the benefit under 35 U.S.C. § 119(e) of U.S. Provisional Patent Application No. 60/346,311, filed 9 Jan. 2002, and U.S. Provisional Patent Application No. 60/393,515, filed 5 Jul. 2002.

FIELD OF INVENTION

The present invention relates to surface injected water drive pressure into a down structure liquid hydrocarbon formation for increasing pressure on its up structure total in place crude oil and/or condensate significantly above their chosen or original bubble point pressures. And for optional miscible gas injection into that liquid hydrocarbon formation's up structure in place crude oil, to add optimum solution gas saturation and pressure to that in place oil as needed. And for producing this solution gas saturated in place crude oil and/or condensate, into the invention's recovery well's specially created lower well bore pressure, again above their chosen or original bubble point pressure, where these liquid hydrocarbons are then pressure injected through the invention's down hole liquid injection tool on into the tool's created and maintained substantially lower pressure production tubing string for final total in place liquid and gaseous hydrocarbon recovery from that liquid hydrocarbon reservoir. The invention relates to a method of significantly increasing recoverable as well as unrecoverable primary and secondary in place oil world wide, to notably extend the world oil recovery peak numerous decades over its present peak.

SUMMARY OF THE INVENTION

The present invention discloses a novel downhole system and method for total in place solution gas saturated liquid hydrocarbons recovery from their formation, above these liquid hydrocarbons original existing or the invention's miscible gas injected created highest crude oil bubble point pressure, into the invention's specially controlled optimally lower well bore pressure and then into its even lower production tubing string pressure.

The present invention also discloses its novel method of returning highly valuable solution gas saturation to in total place crude oil, when in place crude oil is unrecoverable or borderlines being unrecoverable, due to having lost its original solution gas saturation, or can benefit from substantially increasing its solution gas saturation to a desired optimum recovery level, for its conversion to total in place and efficient recovery. Thus the present invention is disclosed for the worlds many types of crude oil formations where total remaining in place oil can benefit from increased solution gas saturation to an optimum high saturation level. Existing wells in these formations as well as newly drilled wells are first equipped and used for the invention's miscible gas injection procedure. Once the miscible gas injection procedure has reached maximum solution gas saturation, these same gas injection wells are then converted to liquid hydrocarbon recovery wells, where the solution gas saturated crude oil and any condensate is allowed to readily flow into their lower well bores. Once flowing into the well's created lower pressure well bore, these liquid hydrocarbons are immediately pressure differential injected by the invention's improved downhole liquid injector tool into the even lower pressure production tubing string provided by this tool on to, or toward the surface. Thus the present invention discloses that its same miscible gas injection wells are to be converted to liquid hydrocarbon recovery wells, which is the invention's most preferred and feasible method. Optionally where sometimes feasible these wells can also be separate as injection wells and recovery wells.

A higher pressure on these in place liquid hydrocarbons in their formation to notably benefit its miscible gas injection procedure and/or its recovery procedure is specially created by the invention's novel water drive pressure on that formation, which is injected down structure from water injection wells, to create an upward optimum water drive pressure force on these up structure liquid hydrocarbons notably above their final existing or chosen miscible gas injected highest bubble point pressure.

The invention's specially created higher up structure formation pressure significantly above its in place liquid hydrocarbons' bubble point pressure allows the invention's recovery wells to controllably drop their well bore pressure in order to pressure differential flow in these liquid hydrocarbons above their bubble point pressure out of their higher pressure formation as pure liquids. As these liquid hydrocarbons flow into the well's lower pressure well bore annulus as pure solution gas saturated liquids still above their bubble pressure, these liquids enter the invention's improved liquid injector tool's internal open float cylinder to submerge it and open its valve into the production tubing string, where the higher well bore to tubing pressure differential injects these liquid hydrocarbons out of the float cylinder upward into the even lower pressure production tubing string, where they are lifted by both well bore to tubing string pressure differential, gas breaking out of solution, and artificial lift, when needed, for the well's continually inflowing liquid hydrocarbon recovery on to the surface.

The invention's downhole liquid injector tool is improved to open at all possible ranges of well bore pressures above the invention's maintained highest possible recovering crude oil bubble point pressures. As the downhole liquid injector continually unloads incoming liquid hydrocarbons recovery flow, at any cycling intervals before free gas can enter its open valve, the float cylinder absolutely positively closes off to any and all free well bore or formation gas to prevent its entering the production tubing string. Liquid hydrocarbon formation gas pressure and solution gas are thus maintained in place in the formation and in the recovering crude oil and/or condensate, and solution gas can only break out of solution from these producing liquid hydrocarbons once they are thru the injector and upstream in the production tubing string.

Thus all possible high well bore and liquid hydrocarbon formation gas pressures, or the invention's created highest formation pressures, are maintained in the well bore and formation respectively, as exclusive liquid hydrocarbon recovery driving forces by the invention's significantly improved liquid injector tool's extended cylinder float system. When the present invention produces and recovers originally and/or specially miscible gas injected solution gas saturated mobile crude oil, its controlled formation to well bore, well bore to tubing string, and upstream flowing liquid hydrocarbon tubing string pressure drop differentials are both created and utilized by its novel downhole recovery equipment system design. The invention's calculated and controlled pressure drops from the formation also beneficially enhance any present gravity drainage from the formation as the maintained fluid liquid hydrocarbons flow toward and into the well bore annulus.

Total in place liquid hydrocarbon recovery is obtained thru the present invention's novel controlled pressure drop recovery methods by the ongoing inflow of in place mobile liquid hydrocarbons completely out of their formation into the invention's created lower well bore pressure annulus as pure non-gassy liquids maintained just above their liquid hydrocarbon's highest existing bubble point pressure. Maintaining high solution gas saturation in recovering in place liquid hydrocarbons keeps them highly fluid and mobile, and at an absolute minimum viscosity, so they can continually freely flow toward and into the well bore. Immediately upon entering the well bore inflowing liquid hydrocarbons enter the improved liquid injector, filling the tool's single or extended cylinder float system, which upon submerging employs the higher well bore to lower production tubing string differential pressure, to pressure differential inject these recovering liquid hydrocarbons up into and through the lower pressure tubing string, where up tubing string liquid hydrocarbon unloading by solution gas break out and/or artificial lift keeps the production tubing pressure down for continued inflowing recovery. When in deeper wells this well bore to production tubing string differential pressure is not sufficient to lift the producing liquid hydrocarbons completely to surface, artificial lift, such as tubing fluid operated gas lift valves or tubing pumps are employed for more efficient and accelerated ongoing upward liquid production through the tubing string.

Thus the present invention's down hole liquid hydrocarbon recovery process automatically operates, in liquid hydrocarbon formations containing original maximum solution gas saturated crude oil and/or condensate, or after the invention's conversion from its miscible gas injection procedure into the formation's crude oil, until total in place solution gas saturated crude oil and/or condensate recovery is obtained from all recovery wells in that reservoir's liquid hydrocarbon formations. Total in place recovery is obtained, because total in place solution gas has remained in place during the liquid hydrocarbon recovery procedure, and has not broken out of the oil or condensate until it is out of its formation and up hole inside the production tubing string on the way to surface storage, as explained in more detail in the following "detailed description".

The present invention's same crude oil recovery procedure just described, works in liquid hydrocarbon and/or natural gas formations containing high percentages of in place condensate or exclusively condensate, for their in place condensate recovery, as found in natural gas fields and/or pure condensate bearing formations, to recover total in place condensate through the production tubing string, while optionally and controllably recovering in place gas up the well's open well bore annulus, while preventing all free gas flow production through the invention's liquid injector tool into the production tubing string.

The present invention is also applied in natural gas formations with significant in place crude oil, or in liquid hydrocarbon formations containing large percentages of natural gas with in place crude oil, where the formations' in place natural gas can be used to re-inject (while this gas is being optionally produced to the surface sales line) through gas injection wells to be converted to recovery wells as seen in FIGS. 9 & 10, in order to re-inject the upper formation's own compatible in place natural gas back into the same formation's lower in place crude oil, in order to give its oil maximum solution gas saturation, for both total recovery of the formation's in place natural gas and liquid hydrocarbons, as described in part below.

The techniques of the present invention disclosed can also be applied in high pressure natural gas reservoirs with in place liquid hydrocarbon influx, for both increased natural gas and liquid hydrocarbon production and recovery, as well as lower pressure natural gas reservoirs with declining gas pressure with highly detrimental-to-gas-production and recovery incoming water and/or liquid hydrocarbons influx. The present invention as specially applied in a principally gas formation's flowing natural gas wells, uniquely produces gas production up the gas well's well bore annulus, while incoming liquids are removed up the well's production tubing string. The invention's down structure water drive pressure can be applied wherever there is not any prior water influx on up structure natural gas formation's in place gas and any in place liquid hydrocarbons, which allows the well bore pressure to be significantly dropped for maximum liquid hydrocarbon and natural gas recovery, while still keeping well bore pressure above its incoming liquid hydrocarbon's required bubble point pressure. In natural gas wells, incoming liquid hydrocarbons cause a serious detrimental-to-gas-flow production back pressure by their heavier incoming liquid or spray gradient into the well bore, i.e., a liquid or liquid spray flow back pressure on the upward flowing gas and its open formation, which the flowing gas production is forced to lift to surface.

In natural gas formations that do not have incoming water influx, the invention's down structure water drive pressure is injected down structure to apply up structure pressure on in place natural gas in its formation, which enhances and even accelerates the formation's in place daily natural gas flow production and ultimate recovery into the invention's maintained free-of-incoming-liquids lower well bore pressure, which in a natural gas well, is controlled at the wellhead casing valve.

While in gas formations with detrimental water influx, although the invention's water drive pressure cannot be applied, the present invention's liquid removal system can be applied for Deliquifying the gas well's well bore of these highly detrimental to gas flow production incoming waters, which are removed through the invention's downhole liquid injector by pressure differential and on into the tubing, where these liquids are lifted by one or more tubing fluid operated gas lift valve injecting lift gas below a plunger lift to plunger lift them on to surface, while producing maximum gas production and recovery gas flow up the well's dry well bore to the surface gas sales line. This latter application is significantly benefited by the addition of the invention's plunger lift system described below.

Another significant feature of the present invention is the addition of its oil industry available "plunger lift" system that operates inside the production tubing string for the invention's liquid injector to tubing operations just above the bottom tubing fluid operated gas lift valve or "venturi tube", in both oil and gas recovery wells with open well bore applications like FIG. 8, or scenarios without gas vent assemblies (but not yet shown in the figure drawings). The plunger lift system, which will have an industry available plunger stop just above the bottom gas lift valve and/or venturi tube, and a "plunger catcher" on the vertical tubing surface well head. The plunger lift addition helps lift all type liquid loads through the production tubing string completely to surface, by maintaining the critical liquid to gas interface particularly in lower pressure gas wells to prevent the upward flowing lift gas being injected from the one or more stage lift gas lift valves from breaking through the liquid column being lifted. The higher pressure injected lift gas could easily break though particularly lower hydrostatic head pressure liquid columns being lifted in the production tubing string and thus lose its needed effective gas lift to the surface. However the traveling plunger works as a solid traveling piston like plunger below the liquid column being lifted to maintain the needed gas/liquid interface and its related efficient liquid lift all the way to the surface by preventing lift gas from breaking though the liquid, and is disclosed as a highly practical and valuable addition for the invention's needed efficient liquid lift to surface. The plunger lift is a feature of the present invention that will benefit any liquid lift, water and/or liquid hydrocarbons, thus benefiting all well bore and tubing operations without gas vent assemblies, as can presently be best visualized in FIG. 8.

The plunger lit system works with the invention's Liquid Injector by or below the open natural gas formation with its single or extended float cylinder system, depending on the gas well operating pressure, in both cases flowing natural gas production and recovery up the gas well's well bore annulus to significantly increase natural gas daily production and its ultimate recovery, due to its gas formation flowing gas free of any incoming liquid burdens.

In lower pressure or declining pressure natural gas formations with significant in place liquid hydrocarbons, natural gas and/or liquid hydrocarbon recovery is particularly enhanced with the application of the present invention, where formation pressure would have dropped below existing gas transport sales line pressure, causing gas wells in the field to "log in" or die, due to liquid hydrocarbon accumulation in these wells. In gas fields with dropping gas formation pressures, the invention prevents well bore liquid accumulation and dropping formation pressure, both of which are critical to both total in place natural gas and in place liquid hydrocarbon recovery. Also, the invention's added water drive pressure on the gas formation will prevent the need for field gas compressors required for gas production later to enter gas sales line pressure higher than the dropping gas formation pressures, i.e., both natural gas recovery and any existing liquid hydrocarbon recovery is substantially enhanced from these gas formations due to the water drive's increased formation gas pressure and the system's ability to produce only liquids through the tubing string.

Also, in significantly higher pressure gas fields, the invention's improved "extended cylinder float system" which allows the liquid injector's float to submerge and open at extreme high pressures, makes detrimental liquid hydrocarbon or water accumulation production or removal, respectively, possible up the well's tubing string through the invention's improved downhole liquid Injector tool in all levels of excessively high pressure gas wells for maximum gas flow production and total in place natural gas and liquid hydrocarbon recovery.

After total in place liquid hydrocarbon recovery from predominantly liquid hydrocarbon formations, the remaining gas cap gas can be fully recovered up the recovery wells' well bores for total in place gas recovery as well as the recovery of its in place liquid hydrocarbons.

Hence in most all recovery stage and gravity type crude oil reservoirs, and in natural gas reservoirs with in place oil, the present invention's miscible gas injection process can be applied to inject miscible gas down into the well's well bore or injection tubing string to directly inject miscible gas into the opened liquid hydrocarbon formation's in place oil, to enter into and contact this in place oil at an optimum injection compression pressure, where it reaches an "equilibrium pressure" in the oil and enters into solution with that oil and returns maximum solution gas saturation to that oil for optimally reducing its viscosity and increasing its fluidity and mobility, for its increased efficient, conversion to recoverable, super enhanced, and/or accelerated total in place recovery.

It is therefore a principal object of the present invention to provide the world oil and gas industries with novel and beneficial miscible gas injection procedures as needed, and its down structure injected water drive pressure procedure where applicable, to work together with the invention's novel multi-method liquid hydrocarbon and natural gas recovery systems, for both total in place liquid hydrocarbons and natural gas recovery, as described and disclosed above.

These and further objects, features and advantages of this invention, will become apparent from the following detailed description, wherein reference is made to the figures in the accompanying drawings.

BRIEF DESCRIPTION OF THE DRAWINGS

FIG. 8 also illustrates a second highly significant application of the present invention for gas flow recovery from natural gas formations. Reference is made to pages 6, 7, 8, 9, & 10 of the "SUMMARY OF THE INVENTION". In this application the incoming liquid level shown at top perforations, would be substantially lower in the casing wellbore CS annulus A, with the formation LH now a natural gas formation, open flowing its gas production from its open perforations up the casing CS wellbore annulus A out the wellhead valve PR to surface gas sales line. This natural gas formation is flowing its gas production dry up the casing wellbore CS annulus at its maximum flow rate, free of all liquid gradients, while any incoming condensates, oils and/or waters from the open gas formation are being recovered at liquid level LL from downhole up though the Liquid Injector DOLI (with or without an extended float as needed), into the separate production string conduct. The present invention's one or more gas lift valves GLV, and its optional venturi jet VJ, above the bottom gas lift valve shown, and/or its plunger lift (not shown) above the bottom gas lift valve GLV are used to efficiently lift the incoming liquids in the tubing to surface. The addition of plunger lift with the gas lift system, is the present invention's option to maintain the needed valuable interface as a traveling piston between lift gas and the liquid column being lifted; without it gas could blow though the liquid, and it is highly effective for lower to average pressure and liquid volume wells, while the present invention's venturi jet works more efficiently for higher pressure & liquid volume wells. The present invention's water drive pressure WDP is maintaining gas formation pressure optimally above its in place gases' critical dew point pressure, maintaining its gas as gaseous, thereby preventing condensate from condensing out of the formation's gas, which causes condensate to problematically form. Preventing condensate from forming in the formation solves the gas production industry's serious problem of "condensate blockage" to gas production flow; thereby obtaining a maximum gas flow production rate, and total in place natural gas recovery. In the few natural gas formations with in place crude oil, the oil is maintained above its optimum bubble point pressure, as a highly mobile fluid during the entire oil recovery procedure, while gas recovery is flowed up the well's wellbore annulus. In a gas formation with detrimental water influx, the invention's water drive pressure WDP is not applied, while its Liquid Injector DOLI downhole in the wellbore injects these waters by pressure differential into the production tubing string, removing them to surface, allowing total in place natural gas to flow dry completely free of this water burden (within the flow rate limitations of the Liquid Injector), for maximum in place gas and any liquid hydrocarbon recovery.

FIG. 13 illustrates a principal application of the present invention's downhole liquid injector DOLI tool as described in FIGS. 3, and 4, and optionally in FIG. 5. Here the liquid injector 3 is demonstrated injecting into the tubing string TS any and all incoming liquids (condensate, crude oil and/or fresh or salt waters) entering the lower wellbore annulus adjacent to gas formation GF, coming from below incoming liquid level LL. As these liquids flow through the liquid injector's sand screen filling its float 4, the float loses buoyancy and submerges, fully opening its double valve, then bottomhole differential pressure forces these liquids out of the float through the double valve's main port and discharge tube, through optional check valve 6, and on up into the lower pressure production tubing TS string connected to the tool's head. By this method all incoming liquids entering the wellbore annulus from the gas formation GF are promptly forced directly into the lower pressure production tubing string TS, while natural gas production flows completely free and wide-open out of the gas formation GF, up the casing wellbore annulus to the surface for sales, completely relived of harmful backpressures of these incoming liquids. The liquid injector's forcing or pressure differential injecting of formation liquids into the production tubing string, momentarily ceases only when its float becomes temporally empty of liquids, rises and closes its double valve, but the moment formation liquids enter and fill it once more, it submerges and opens again. As a result all incoming formation liquids are instantaneously removed toward surface through the production tubing string, and all natural gas production flows dry wide-open up the well's wellbore annulus onto the surface, for maximum gas and liquid hydrocarbon production and ultimate recovery sales for the gas wells basic gas recovery life. Demonstrated in FIG. 13 is how the present invention optionally improves this gas production procedure for both primary as well as secondary gas recovery when there is no existing water aquifer or water influx in the gas formation. Then the present inventions optional surface injected down structure water drive pressure WDP can be optionally employed to compresses the majority of in place gas within its formation above its dew point pressure, controlling condensate blockage, for both accelerating and increasing gaseous and liquid hydrocarbon production and recovery. Depending gas well depth, in some cases this surface injected water drive pressure WDP can build up gas formation pressure high enough to pressure differential lift liquid hydrocarbons though the liquid injector 3, completely to surface without any artificial lift assist. When significant crude oil is present as it is in many natural gas formations it is produced as described in preceding FIG. 8 (and when needed optionally FIG. 7) of the present invention, by wellbore to formation pressure being controlled from the well's wellhead valve during oil production above its vital bubble point pressure, being optionally and optimally benefited by the inventions surface injected down structure water drive pressure WDP.

FIG. 13 illustrates liquids being injected through the liquid injector's 3 open float 4, through its open double vale, through its discharge tube, (through optional check valve 6,) passing on up the tubing string TS passing the first tubing fluid operated gas lift valve 7, (through optional venture tube 8,) on through the multi orifices of plunger lift stop with spring 9, passing on by the plunger lift 10. When these liquids arrive at a predetermined liquid level in the production tubing string, their liquid pressure opens the bottom gas lift valve 7. The opening gas lift valve 7 introduces wellbore gas of a higher pressure than the liquid level pressure into the production tubing string TS and flows upward to drive the plunger lift 10 with the liquid load above it on up the tubing string with additional gas lift valve injected gas lift boast as needed up hole, driving said liquid load on to surface, where it's discharged for removal, or the case of liquid hydrocarbons for valuable sales. As in all preceding figures related to well depth a series of gas lift valves are located up the tubing string in order to give needed gas lift boast to the rising plunger lift. Optional check valve 6 and venturi tube 8 are in most cases left out due to their orifice restriction to liquid flow. The purpose of the plunger lift is to maintain the gas flow to liquid column interface on the gas lift drive upwards; otherwise gas lift valve injected gas could possibly brake through the liquid column on the lengthy trip up the production tubing string, and lose its effective gas lift. However in high liquid volume wells when the plunger lift doesn't have time to fall back down the tubing string, it is completely left out, and the most feasible type of (casing or tubing operated) high liquid volume gas lift valves are utilized. Here when needed, the venturi tube 8 can be employed to help create a vacuum draw to upward fluid flow and to better distribute a mixture of gas below the liquid column being driven out to surface.

DETAILED DESCRIPTION OF PREFERRED EMBODIMENTS

Water Injection Well Features and Operation

Figure 1:
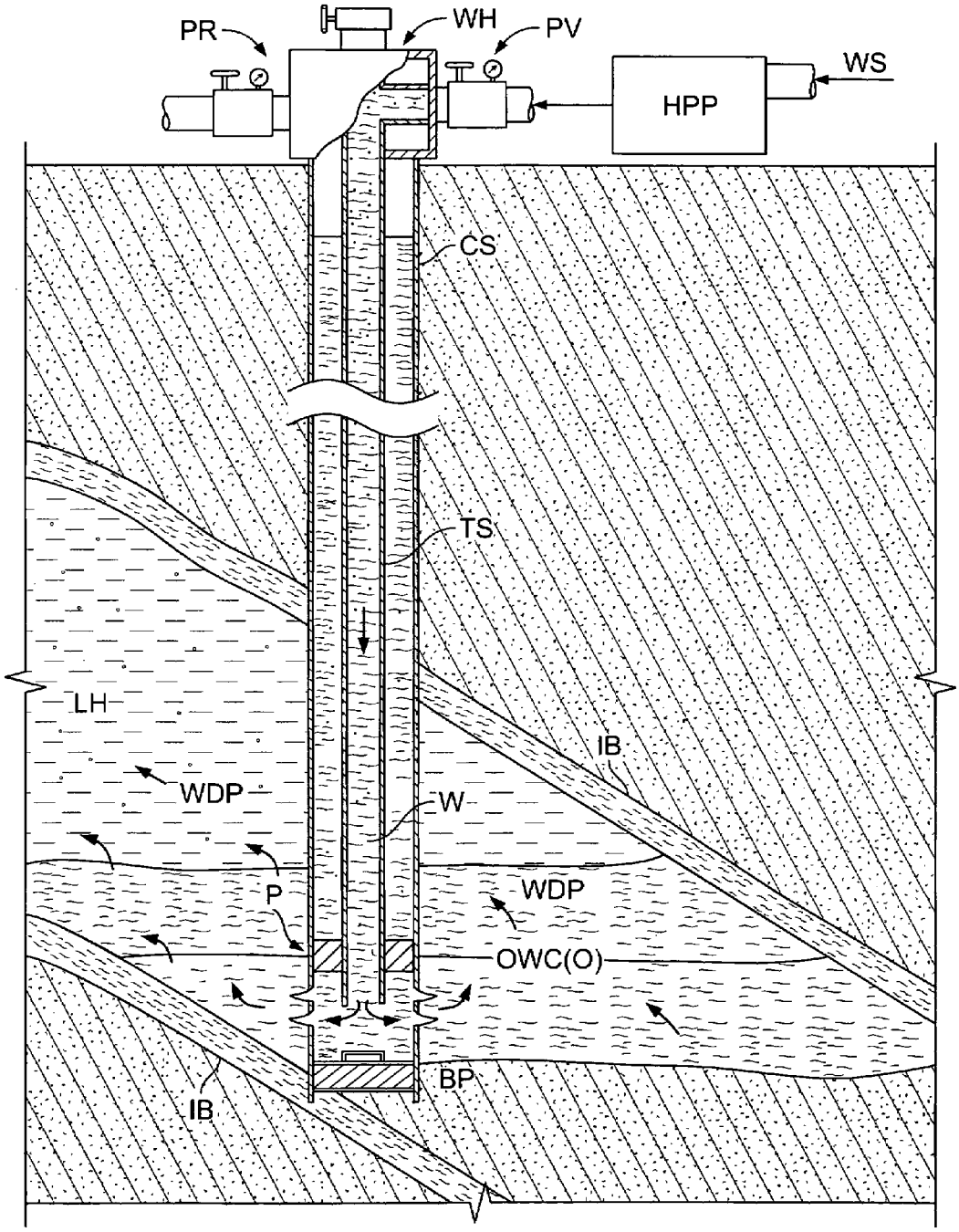
FIG. 1 illustrates one of the principal features of the present invention, which is its one or more water injection well(s) injecting water into a lower or down structure section of a crude oil formation, where the injected water drive force gradually moving up formation increases and maintains pressure on in place oil (and any overhead gas) significantly above its original in place, and/or increased bubble point pressure, optionally created by this invention's miscible gas injection procedure through wells up structure, and optionally for maintaining optimum water drive pressure on that oil during this prior miscible gas injection procedure. The present invention's down structure water injection procedure is also applied on natural gas formations, to increase pressure up structure on in place natural gas significantly above its dew point pressure to reach a maximum gas flow production rate and to positively eliminate "condensate blockage", for total in place natural gas and any in place liquid hydrocarbon recovery into the present invention's recovery wells where liquids are produced through the Liquid Injector into a separate tubing conduct and gas is flowed dry up the wellbore annulus.

FIG. 1 illustrates the primary components of a water injection well as applied in the present invention, pressure pumping and injecting water W from an outside or internal field water source WS through a high pressure surface pump HPP into the well's wellhead tubing production valve PV through a connected injection tubing string TS and down into the lower part of a down structure liquid hydrocarbon formation LH containing in place crude oil and/or condensate (liquid hydrocarbons). The open ended injection tubing string TS and opened (perforated, and/or open hole and/or horizontally drilled) liquid hydrocarbon formation LH are isolated by a tubing string TS to casing string CS packer P. The original well kill fluid seen remaining in the tubing to casing annulus above packer P can provide an additional overhead pressure above the packer if needed.

The liquid hydrocarbon formation LH, which shows impermeable barriers IB to the liquid hydrocarbon formation above and below it in FIG. 1, may be with or without an original, or secondary associated gas cap, and with or without an associated lower water zone. The injection tubing string TS is installed into the chosen water injection well's well bore casing where it is isolated by the packer P for injecting water W into this lower structure liquid hydrocarbon formation's LH lower part or existing water zone below the original oil water contact OWC (O). The outside or internal field source WS water W is pressure pumped by the surface high pressure pump HPP down the injection tubing string TS into the down structure lower part of its liquid hydrocarbon formation LH to create and maintain an optimum water drive pressure WDP force up structure on its in place crude oil and/or accompanying condensate, significantly above its oil's and/or condensate's original high or predetermined chosen bubble point pressure. The water injection well is shown with its well bore or casing string CS plugged with a bridge plug BP or casing shoe at the bottom of the liquid hydrocarbon formation's LH lower section or associated water zone, where the casing is perforated or the well bore is opened into the lower part of the liquid hydrocarbon formation LH defined by the original oil water contact OWC (O) below the packer P.

Basic surface equipment for the water drive WDP injection procedure includes the high pressure water pump HPP and wellhead WH and a tubing production valve and gauge PV connected to the injection tubing string TS to receive the pressure pumped water W from its surface source. Also other feasible industry liquids can be used if preferred over water. Water W quality should be assured; brines from reservoir operations or seawater, where available, add a benefit of density increase.

In liquid hydrocarbon formations containing significant remaining in place crude oil that has lost its valuable solution gas, pressure and related recoverability, where the invention's miscible gas injection procedure as seen in later FIGS. 2, 7, 9 & 11, is used to return or add maximum solution gas saturation and pressure to this in place crude oil, the purpose of the present invention's injected added water drive pressure WDP down structure in the liquid formation LH is to increase the liquid hydrocarbon formation's LH up structure pressure to significantly above its in place crude oil's predetermined and newly sought bubble point pressure obtained by the invention's miscible gas injection procedure. This increased water drive pressure WDP on the formation's LH total in place liquid hydrocarbons is specially created to assist both the described invention's miscible gas injection procedure when initiated up structure in the same liquid hydrocarbon formation LH, as well as during its solution gas saturated liquid hydrocarbon recovery procedure when initiated as described in following FIGS. 8, 10 & 12.

While in the case of a new or original pressure liquid hydrocarbon formation LH containing optimum solution gas saturated crude oil and/or condensate and pressure, the present invention's added water drive pressure on the liquid hydrocarbon formation's LH in place liquid hydrocarbons, which is also made to be significantly above their original bubble point pressure, is made to primarily assist during the invention's novel liquid hydrocarbon recovery procedure into the production well's well bore. During the liquid hydrocarbon recovery procedure, the invention's downhole system drops well bore pressure below the liquid hydrocarbon formation's LH higher formation pressure while still remaining above its recovering liquid hydrocarbon's bubble point pressure, for close to total in place liquid hydrocarbon recovery, as described and shown in FIG. 6.

In principally crude oil bearing formations LH where the invention's miscible gas injection is applied up structure, this added down structure water drive pressure is continually maintained to be notably above the up structure liquid hydrocarbon formation's in place crude oil's highest or chosen bubble point pressure during its crude oil recovery procedure in these same miscible gas injection wells when converted to production wells, as seen and described in FIGS. 2, 7, 8, 9, 10, 11 & 12. FIG. 1 illustrates how the original oil-water contact can move up formation from its original oil water contact OWC (O) as the water drive pressure WDP follows the recovering gas-saturated liquid hydrocarbons upward in the liquid hydrocarbon formation.

Figure 2:
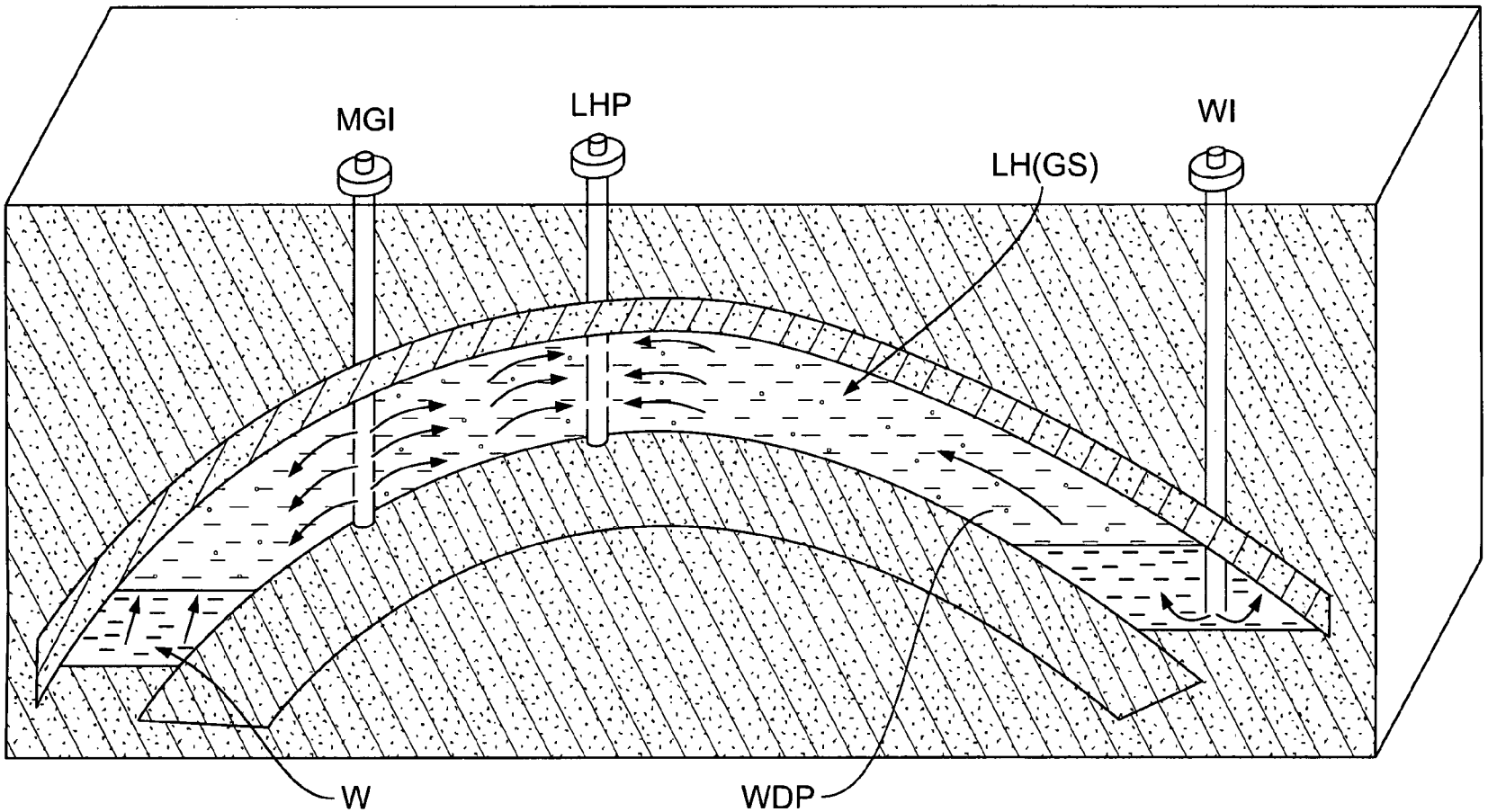
FIG. 2 The present invention is applicable in most all types of crude oil gravities and reservoirs and is meant to be applied in an entire oil reservoir, although sections can be also chosen. Shown is a simplified pictorial view of a cross-section of a gradual dome type oil formation's in place crude oil being pressured up structure above its bubble point pressure by the present invention's one or more down structure water injection wells' WI, water injection procedures, as seen in FIG. 1. This same in place crude oil has been optimally saturated with solution gas by the present invention's up structure miscible gas injection wells' MGI earlier miscible gas injection procedures, in order to flow this newly highly mobile solution gas saturated crude oil back into these same MGI injection wells when converted to the complex's recovery wells LHP in that oil reservoir for total in place oil recovery. The invention's water injection wells WI are permanent during the entire oil recovery procedure, while all its miscible gas injection wells MGI in the field after completing their gas injection processes, are converted to oil recovery wells LHP, for the invention's recovery of total in place crude oil

Field Water Injection Wells, Miscible Gas Injection Wells and Converted Liquid Hydrocarbon Recovery Wells FIG. 2 illustrates schematically the liquid hydrocarbon formation with the present invention's three types of well operations used to: first pressure up the liquid hydrocarbon formation's in place liquid hydrocarbons down structure by one or more water injection wells WI which create a water drive pressure WDP on these in place liquid hydrocarbons; second, to return solution gas to the in place crude oil liquid hydrocarbon (gas saturated) LH(GS) by the one or more miscible gas injection wells MGI up structure, and third, to recover those total in place liquid hydrocarbons through the one or more converted miscible gas injection wells to liquid hydrocarbon production wells LHP.

Shown exclusively injecting water into the lower part of the down structure liquid hydrocarbon formation to create a water drive pressure WDP on the up structure liquid hydrocarbon formation are the one or more water injection wells WI as described above in FIG. 1. The water injection wells do not convert to other operations but only operate as water injection wells. The purpose of the invention's water injection procedure is to pressure up and maintain a water drive pressure WDP on the gas saturated hydrocarbon formation's in place crude oil with any accompanying condensate LH (GS) to significantly above the crude oil's predetermined highest bubble point pressure, to both benefit the miscible gas injection and converted liquid hydrocarbon recovery procedures. Also shown are one or more miscible gas injection wells MGI up structure injecting miscible gas into the same liquid hydrocarbon formation which is being pressured, to above the miscible gas injection procedure's final bubble point pressure into the formation, by the down structure water injection procedure from the water injection wells WI. After optimum solution gas saturation and pressure is reached in the in place crude oil, these miscible gas injection wells are converted to liquid hydrocarbon production wells. The present invention's miscible gas injection wells that convert to solution gas saturated liquid hydrocarbon production wells LHP are disclosed in greater detail in the following FIGS. 7 through 12.

Figure 3:
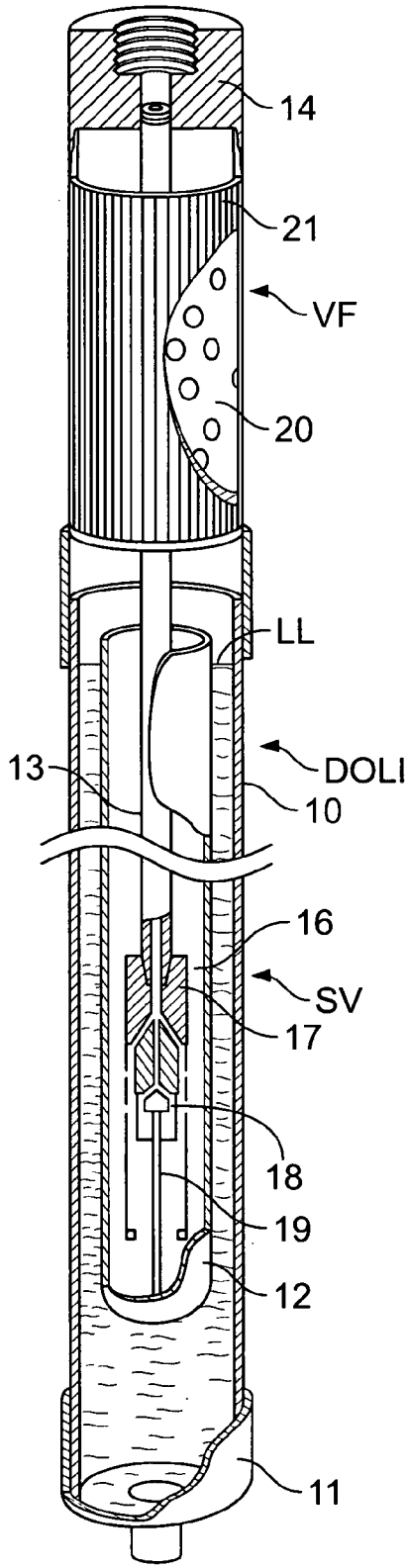
FIG. 3 illustrates a cross-section view of the present invention's downhole Liquid Injector's DOLI principal operating tool features. Starting with its head's connection onto the bottom of the production tubing string, then its liquid inlet screen VF, and with a cut away illustrating its opened at top and closed at bottom cylindrical float-operated main 17 & pilot 18 valves, double valve system, that opens and closes as this float fills with incoming wellbore liquids, and submerges, discharging these liquids by wellbore to tubing pressure differential, then rising and closing by its empty float's buoyancy, as shown, until it becomes liquid filled again to submerge and open to continually repeat its liquid injection process into the production tubing.

FIG. 3 illustrates the primary components of the Downhole Liquid Injector DOLI tool disclosed and described in the present invention, as the principal novel liquid hydrocarbon production and recovery tool that recovers solution gas saturated liquid hydrocarbons (crude oil and condensate) by the present invention's maintained well bore pressure, above the formation's liquid hydrocarbon's chosen bubble point pressure, to the lower pressure production tubing string pressure differential, while maintaining these liquid hydrocarbons above their bubble point pressure until they are pressure injected through the Liquid Injector DOLI into the lower pressure production tubing, where they are produced to the surface by pressure differential, solution gas breaking out of solution in the hydrocarbon liquids, and/or artificial lift methods.

The Liquid Injector DOLI illustrated comprises the following basic components. A float 12 constructed of a relatively thin stainless steel, for example: 14, 16, 18 or 20 gauge, and 2½, 3 or 3½-in. outside diameter, depending on well bore and Liquid Injector size, and approximately 24-ft. long (for a single-length, for operating in lower well bore pressures). The float 12 operates within an outer housing 10 of basic carbon steel, typically containing male threads on top and bottom for connection of a top collar and a bottom female bull plug 11, with threads for either a male bull plug or an additional length of tubing for powdery sand collection. Male threads and collars can be designed to create a flush outside diameter for the complete DOLI. Gauges and sizes will vary with well operating conditions and casing size.

The housing 10 will be permanently filled to a liquid level LL with a liquid such as treated brine. The float 12 operates within this liquid, and its buoyancy, i.e., whether it rises or falls, depends on the density of fluids (liquids or free gases) that enter the float 12 from the well bore. Liquid hydrocarbons or water will add sufficient weight to cause the float to submerge. Gas will increase float buoyancy, causing it to rise. The function of float 12 movement is to open or close the double shutoff valve SV attached to the bottom of discharge line 13, extending from the bottom of Injector head 14 which also contains the female thread for direct connection to the production tubing. The bottom of the discharge line 13 contains valve seat 16 for main valve tip 17. This main valve size can vary from smaller or larger than 11/16-in. diameter.

The Liquid Injector DOLI of the present invention, features a double valve through which pressure differential, between well bore pressure, as applied into the float on to the closed main valve, vs. lower pressure within the discharge line 13 to the tubing, is reduced by the initial opening of a pilot valve of 3/16-in. diameter (or smaller or larger, as needed). The pilot valve tip 18 is located on a short valve stem 19 attached to the bottom of the float. The tip contacts the 3/16-in. opening through the main valve tip, and opens first, breaking the pressure differential seal and allowing the falling float 12 to pull open the main shutoff valve SV. The Liquid Injector is equipped with an effective, optional vertical or horizontal-screen type sand/debris filter VF, which is screwed into the top collar of the housing 10 and into the bottom female thread of Injector head 14. The screen filter VF, features a base pipe with multiple ports 20 providing a high screen collapse rating, and screen slotted openings 21 containing slots of approximately 0.010 in. width, or as needed, for optimum formation sand and well debris screening efficiency and downhole life.

Figure 4:
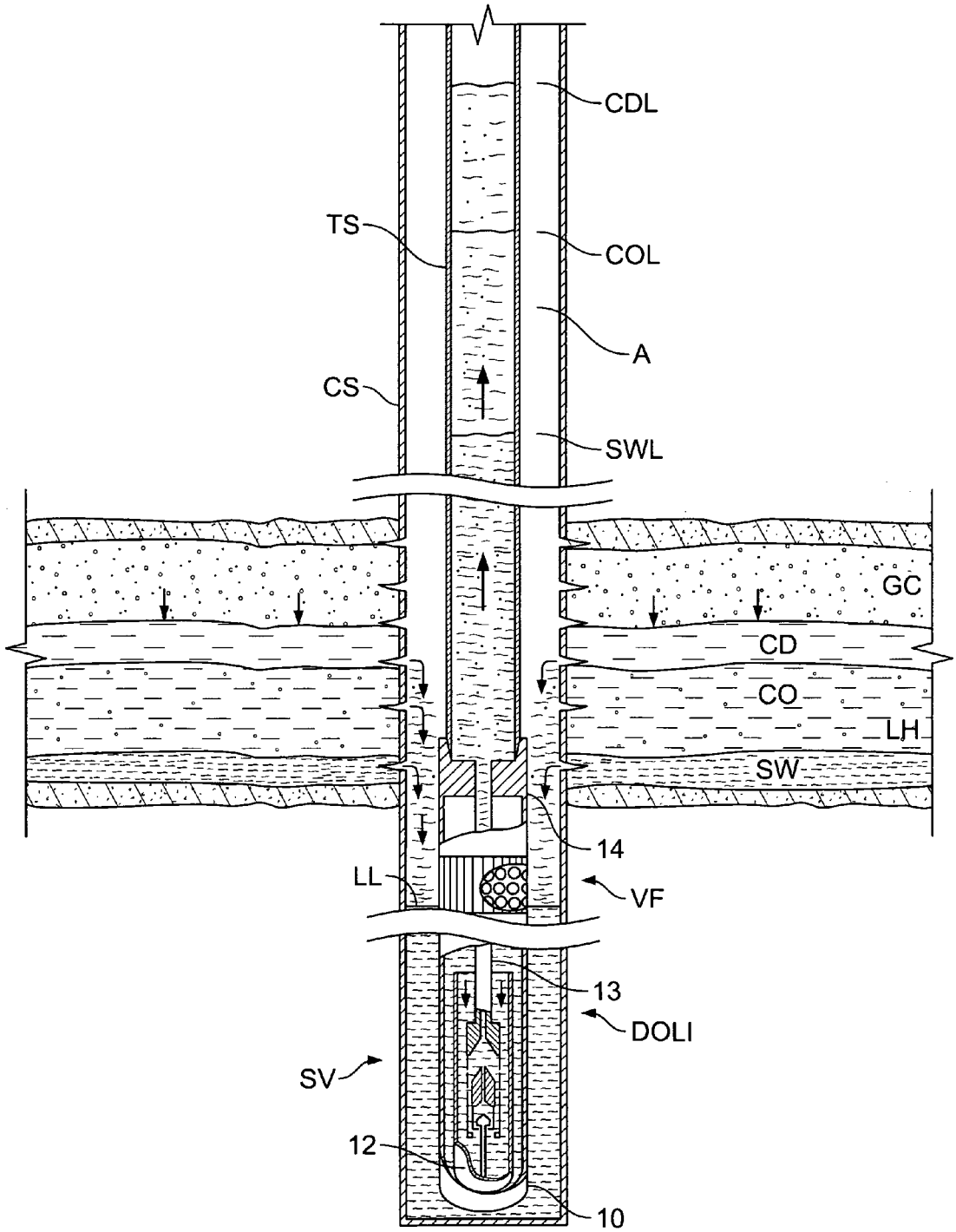
FIG. 4 illustrates an example of how various natural gas or liquid hydrocarbon formation liquids, condensate CD, crude oil CO, and salt water SW, flow downward in the wellbore to fill and open the present invention's, Liquid Injector's float, where they are injected by wellbore to production tubing pressure differential toward the surface in that production tubing string. Relative liquid levels, condensate level CDL, crude oil level COL, and salt water level SWL, that a given operating bottom hole wellbore pressure would lift each liquid through the Liquid Injector's float according to its static gradient, are shown for illustration of the Liquid Injector's static liquid lifting abilities. When needed, the invention's artificial lift methods are applied to lift these liquids to surface.

FIG. 4 illustrates the present invention's downhole Liquid Injector's DOLI production and recovery method application producing a liquid hydrocarbon formation's LH liquids toward the surface through a tubing string TS as they enter the main well bore in which an optimum pressure is maintained on the liquid hydrocarbon formation LH and its gas cap GC above its in place liquid hydrocarbon's given or chosen bubble point pressure through the present invention's applied water drive pressure WDP down structure. The liquid hydrocarbon formation LH may also be without a gas cap GC, with water drive pressure above its crude oil's chosen bubble point pressure on it as the invention's added liquid hydrocarbon recovery force. In the liquid hydrocarbon formation LH, all formation liquids are shown naturally separated according to their density when present: on top is formation gas in the gas cap GC, then condensate CD, crude oil CO, and salt water SW. The well bore annulus A pressure is just above the open liquid hydrocarbon formation's LH chosen crude oil's bubble point pressure, but equal to that formation's pressure or lower, allowing its mobile solution gas saturated hydrocarbon liquids (and any present water) to flow freely as pure liquids into the well bore by their heavier liquid gradient. Once entering the well bore annulus A, these liquids immediately enter through the Injector's sand screen VF and fill the Injector's float 12, where the invention's maintained well bore pressure injects these recovering liquids up through the Injector's opened valve SV, through its discharge line 13 into the lower pressure production tubing string TS to a level equal to the bottom hole well bore annulus A pressure which maintains that liquid's level governed by the liquid's gradient up the tubing, which is open to the surface.

For example, in the present invention's application in a well operating at 3,000-psi well bore pressure producing condensate CD at 0.320 psi/ft gradient, the well bore pressure would move incoming condensate through the open Liquid Injector up to a 9,375-ft. static level CDL in the tubing string TS toward the surface above the injector. In a well producing 30° API crude oil CO at 0.380-psi/ft gradient, the 3,000-psi well bore pressure would maintain the crude oil to a static level COL of 7,894 ft. up the tubing string. Salt water SW, if present, with a 0.478-psi/ft gradient would be driven to a level of 6,276-ft. SWL. However, not shown in FIG. 4, because there is a pressure reduction inside the tubing string TS to the incoming liquid hydrocarbons, gas breaks out of solution as these liquid hydrocarbons pass their bubble point pressure level, which helps flow these upward moving liquid hydrocarbons on toward the surface. In well bores with sufficient high pressure differential related to well depth, liquid hydrocarbon recovery can be completed without artificial lift. Where sufficient pressure differential is not present, artificial lift is required.

Figure 5:
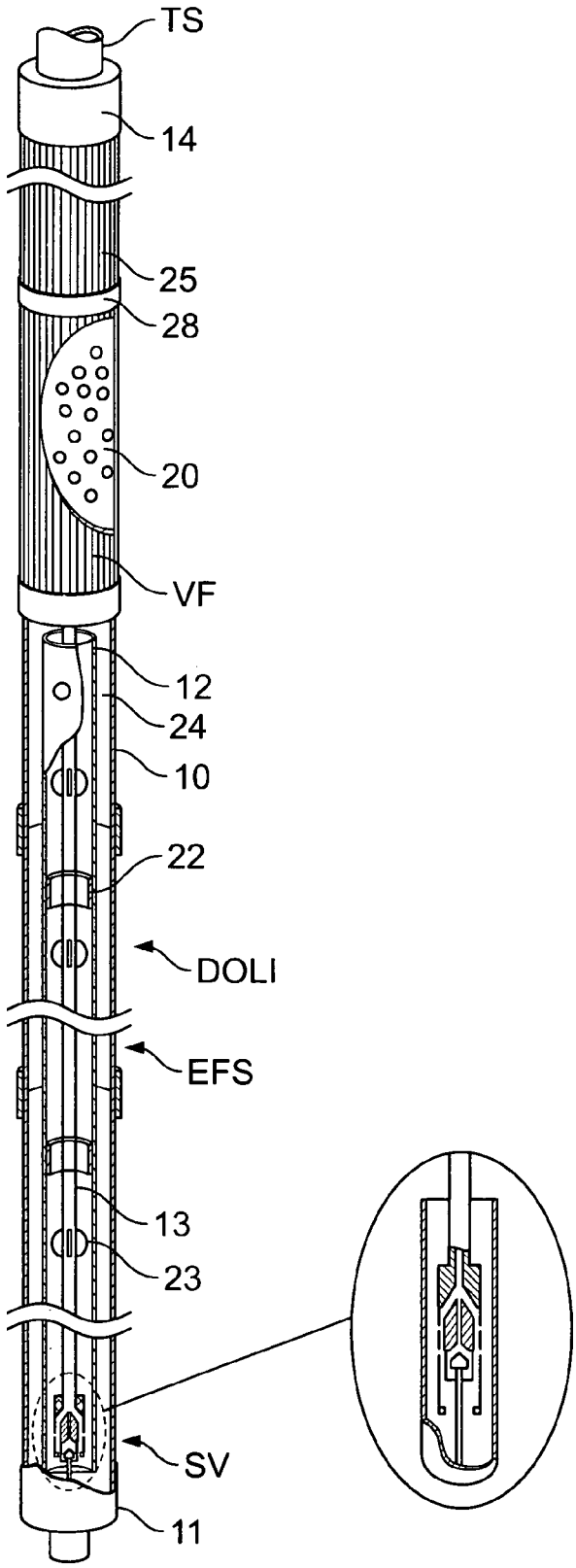
FIG. 5 illustrates the present invention's Liquid Injector's alternative extended length float EFS, required when excessively high formation to wellbore pressure, and minimum tubing pressure, create a high pressure differential so high such that the net single length liquid-filed float weight (as seen in FIG. 3) cannot open the float's pilot valve. The present invention's extended length float adds the weight as needed; and to further lower high pressure differentials, it can be counterbalanced by liquid load in the tubing above it (as seen in FIG. 4). These needed improvements to the tool will open the Injector's pilot valve at all variable exceptionally high operating bottom hole wellbore pressures created by the present invention's optional high water drive, gas cap and miscible gas injection pressures.

FIG. 5 illustrates principal features of the present invention's Liquid Injector's DOLI Extended Float System EFS, in which the Injector's float 12 length is substantially increased by one or more standard float lengths to provide increased net float weight to open its shutoff valve's SV pilot tip against the invention's operating high pressure differentials between well bore and production tubing TS, to provide a novel positive solution for high-pressure liquid hydrocarbon recovery maintained above its bubble point pressure. In the extended float 12 system EFS, Injector housing length 10 is increased by adding threaded pipe sections. The bottom bull plug 11 remains unchanged.

The Injector shutoff valve SV as seen in FIG. 3, remains the same, as it is shown only schematically in FIG. 5. The discharge tube 13 can be optionally equipped with fin-type centralizers 23 to keep the float centered to the discharge tube in crooked or slightly deviated wells. The exterior of the float 12 optionally has half spheres of about ¾-in. diameter 24 spaced on the outer surface to prevent float contact friction against the housing's internal diameter. Float sections are connected by internal special float material flush collars and threads 22 to achieve desired length and maintain original outside diameters. Each float section is precision-reinforced to be threaded for collar connectors 22. The screen filter can be lengthened as needed to give the vertical or horizontal filter VF surrounding the ported base pipe 20 additional flow volumes. For example, a 3.75-ft., 4½-in. outside diameter screen section can produce approximately 750 bbl/day liquid flow. Additional filter sections 25 can be added for the present invention's increased higher liquid volume production application, as needed, by screwing into a collar connection 28. The top section screws into the Injector head 14, into which the tubing string TS is connected.

Recovering Liquid Hydrocarbons by Maintained Optimum Recovery Pressure

In the following FIGS. 6 through 12 shown, one of the principal novel functions disclosed and taught by the present invention is how to directly create by injected water drive, a maintained pressure WDP on the in place liquid hydrocarbons, crude oil (and any accompanying condensate) present in the liquid hydrocarbon formation LH, to be notably above their original bubble point pressure, and/or chosen last or highest bubble point pressure. The in place crude oil's chosen highest bubble point pressure would be after the invention's miscible gas injection directly into the in place crude oil seen in FIGS. 7, 9 & 11, where it returns the optimum desired level of solution gas saturation and pressure to that in place crude oil, reducing its viscosity to increase its mobility and related recoverability. The present invention goes on to disclose just how to recover that solution gas saturated crude oil (and any accompanying condensate) above its desired bubble point pressure, which retains its recoverability into the recovery well's well bore to a significant pressure drop within that well bore, but still above that recovering oil's bubble point pressure. The present invention goes on to disclose and teach how this is accomplished through the invention's novel downhole Liquid injector DOLI with its extended float system EFS with maintained liquid hydrocarbon formation's LH well bore annulus A pressure, as controlled by its gas vent assembly GVA shown in FIGS. 6, 10 & 12, or its wellhead WH pressure regulator PR shown in FIG. 8.

The following figures describe how the present invention's miscible gas injection process is done and is benefited by the invention's water drive pressure WDP. Further described is how the invention's liquid hydrocarbon formation's LH liquid hydrocarbon recovery is accomplished, also benefited by its water drive pressure WDP.

Figure 6:
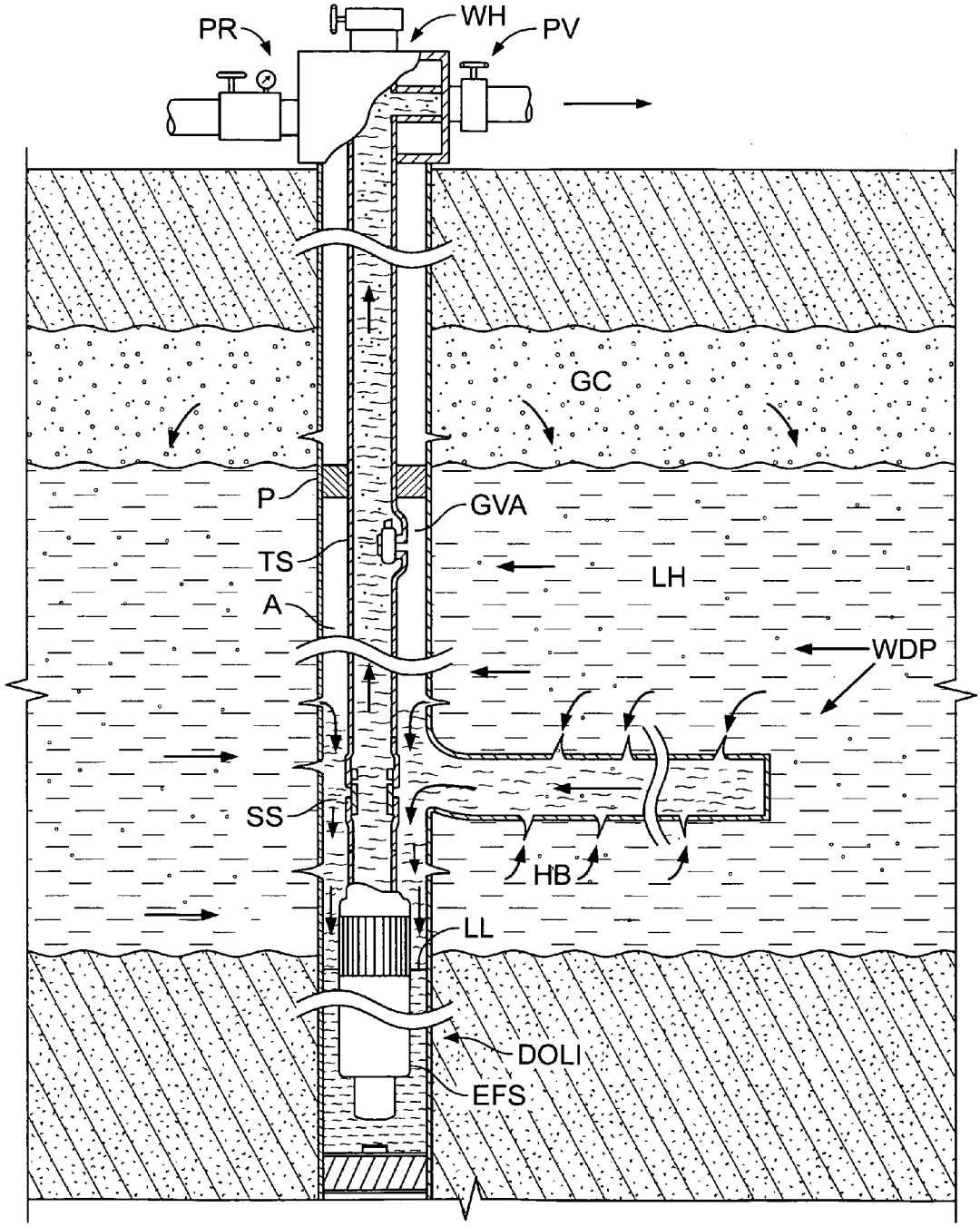
FIG. 6 illustrates schematically original primary in place solution gas-saturated crude oil; or tertiary, secondary or primary crude oil optimally solution gas saturated after the present invention's miscible gas injection procedure. Both scenarios are flowing this solution gas saturated oil into perforated horizontal and/or vertical wellbores, where the wellbore or wellbores are maintained at an optimum lower pressure, still above the oil's highest existing bubble point pressure, controlled by the present invention's gas vent assembly GVA, but high enough to flow this incoming crude oil through the Liquid Injector's opened float and valve to surface. When needed, artificial lift can be used. Optimum pressure on this crude oil above its highest existing bubble point pressure in its formation is specially created and maintained by the invention's down structure water drive pressure WDP, which also creates additional pressure on the gas cap GC. Optional additional gas-cap GC gas injected gas drive pressure can be used in the present invention, when feasible and needed.

FIG. 6 illustrates the present invention's liquid hydrocarbon recovery system recovering liquid hydrocarbons to the well's surface without artificial lift, by maintained optimum well bore annulus A pressure above the liquid hydrocarbon formation's LH in place liquid hydrocarbon's given bubble point pressure, although artificial lift can be applied when needed as seen in later FIGS. 7 through 12. Illustrated in FIG. 6 are a newly drilled and/or an original pressure, perforated, open hole, and/or horizontally drilled, opened liquid hydrocarbon formation LH, containing original solution gas saturated crude oil and/or condensate "liquid hydrocarbons". All open liquid hydrocarbon formations LH in which the present invention is applied may be perforated, deep perforated, open hole and/or horizontally drilled. The liquid hydrocarbon formation's LH gas cap's GC (when perforated) optimum required gas pressure is shut in, or controlled and monitored by the surface wellhead pressure regulator valve and gauge PR, to help maintain pressure created by the invention's water drive pressured WDP down structure sufficiently above the formation's LH crude oil's highest original bubble point pressure. The gas cap can be perforated or not perforated, and the formation LH can also be without a gas cap.

As shown in FIGS. 1 & 2, the present invention's down structure water injection provides the liquid hydrocarbon formation LH with the needed added water drive pressure WDP to notably increase its formation's LH in place liquid hydrocarbon's pressure notably or high enough above its original or designed miscible gas injection's highest bubble point pressure to allow a significant drop of pressure into the well bore during the solution gas saturated crude oil recovery process, to encourage liquid hydrocarbon flow into the well bore, but still be above the in place liquid hydrocarbon's highest bubble point pressure. This is the advanced liquid hydrocarbon recovery advantage achieved by the added water drive pressure WDP disclosed and described in the present invention that will recover the maximum and highest majority possible of the total in place crude oil, at an accelerated rate well over any prior art. This maintained down structure water drive pressure WDP injection will gradually replace the recovering liquid hydrocarbons up structure as they are produced out of that formation LH, as the gas cap will expand and replace them down structure.

Figure 9:
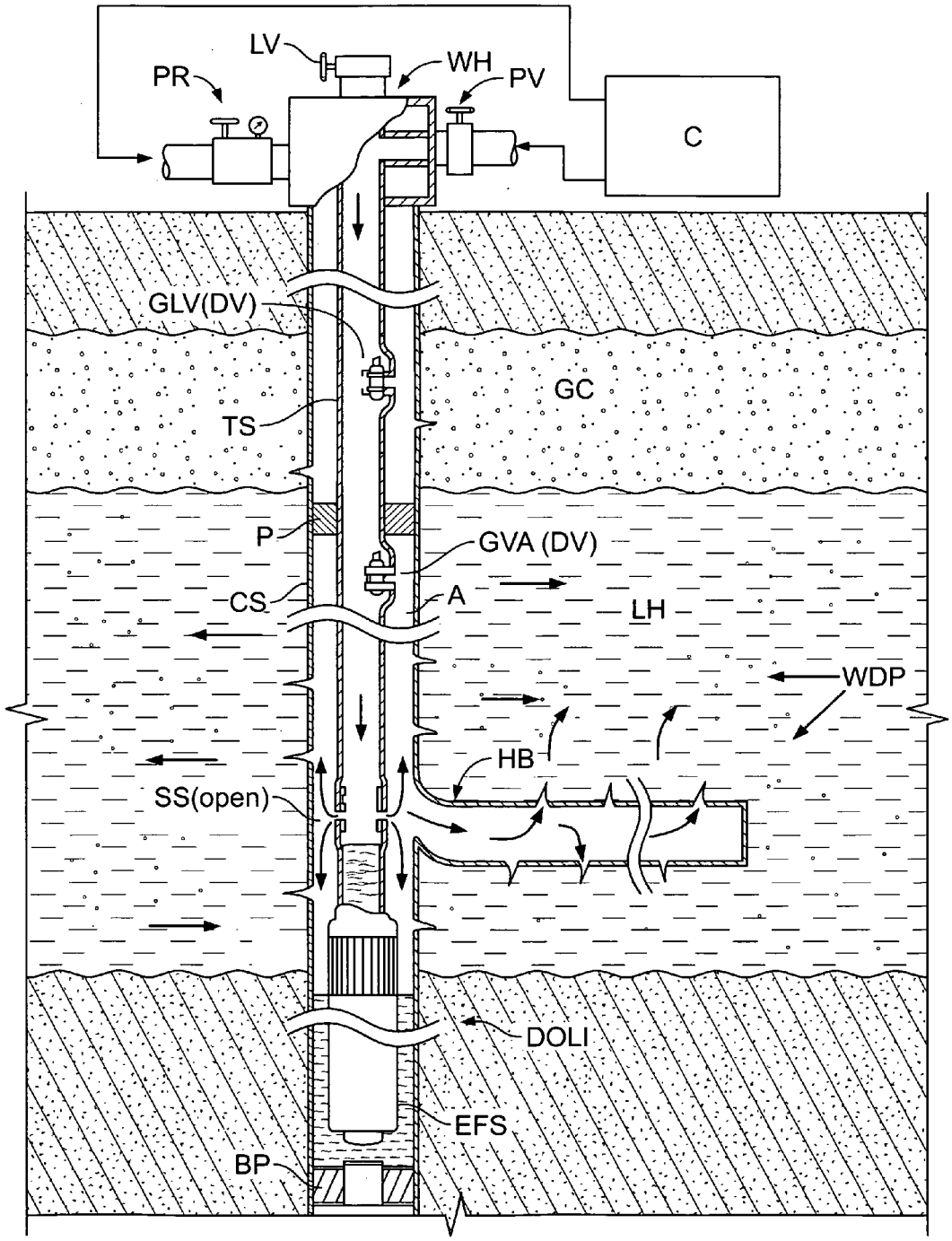
FIG. 9 illustrates a highly significant feature of the present invention, where natural gas compatible with its own crude oil is drawn directly off the oil formation's LH associated upper gas cap GC above packer P, by the surface compressor to re-inject this same gas down the tubing and out the open sliding sleeve directly back into its own oil formation, to reenter into solution with its compatible oil, thereby adding optimum solution gas saturation for its enhanced and total in place recovery. The arrow pointing into the casing annulus and pressure regulator valve PR from surface compressor C indicates natural gas being drawn off the gas cap GC through the pressure regulator valve PR by the compressor C. Reference for this method of the present invention is also made to FIG. 2 of patent application Ser. No. 10/340,818 of which this application is a CIP. When sufficient gas cap gas is not present for use as a compatible miscible gas, an outside source of miscible gas can be used, while optionally miscible or non-miscible gas can be injected down the upper wellbore annulus into the opened gas cap for increased overhead gas pressure drive. The invention's optional water drive pressure WDP is usually not required during the miscible gas injection procedure; however it can be used to benefit the miscible gas injection procedure when needed. Preinstalled gas lift and gas vent valves are equipped with dummy valves during this gas injection process, then armed with real gas lift valves by wireline, before the present invention's conversion to its oil recovery process.
Figure 11:
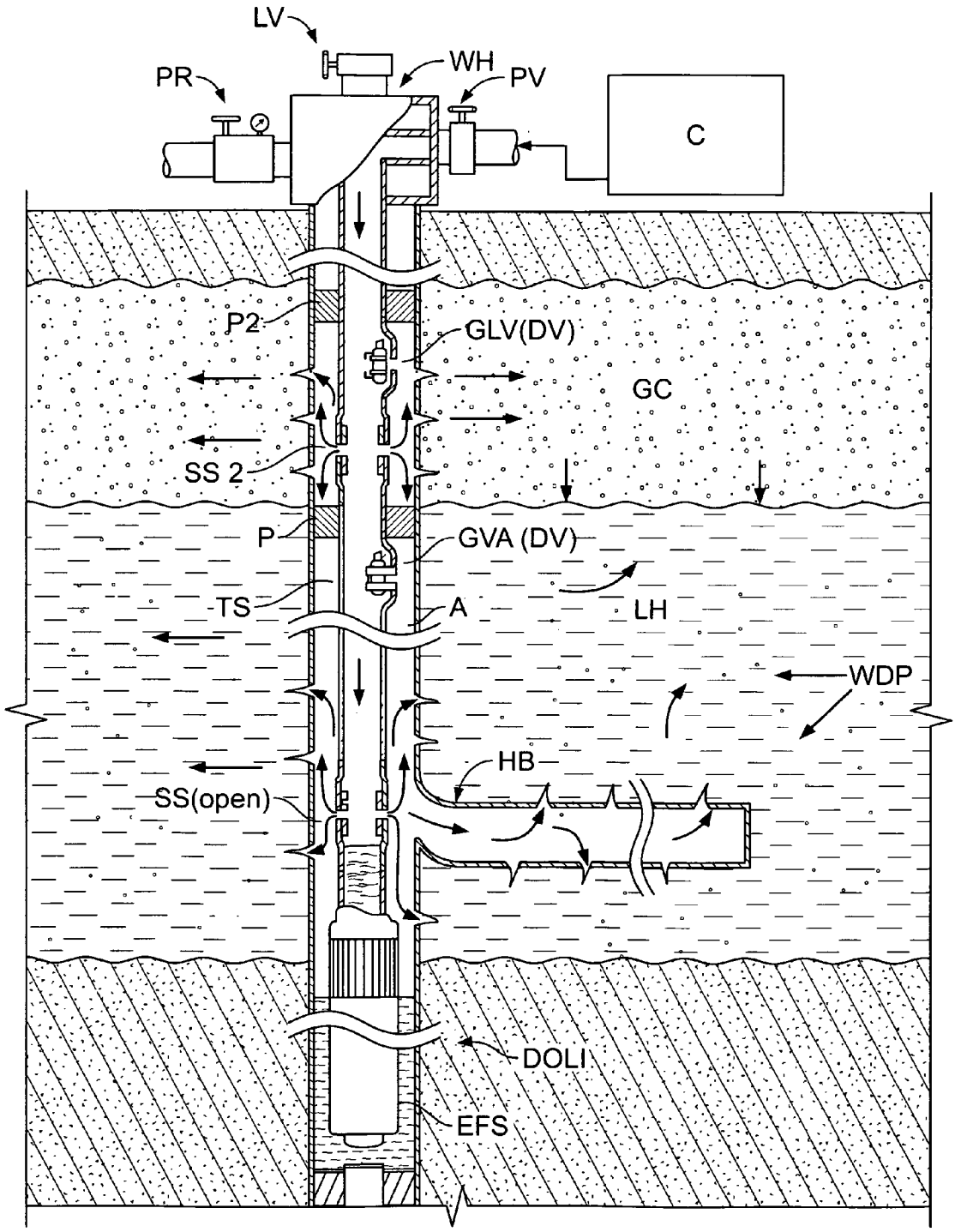
FIGS. 11 and 12 illustrating the present invention are similar to the miscible gas injection procedure of FIG. 9, when an outside source of miscible gas is being used, and the oil recovery procedure of FIG. 10, with the exception that the perforated crude oil formation LH and its associated open gas cap GC are located below upper open hydrocarbon formations, which requires that injection and production zones be isolated by a second packer above the gas cap, and a second sliding sleeve to open and close the gas cap to the tubing for these procedures. Thus this perforated oil formation below other open formations can be miscible gas injected and recovered independently from other formations in the same well, without expensive plugging etc.

Schematically shown in the well bore annulus A below the liquid hydrocarbon formation LH is the Liquid Injector DOLI which can be with an extended float system EFS as needed, as seen in FIGS. 3, 4 & 5. Also shown in FIG. 6 is a closed sliding sleeve SS on the tubing string TS, which can be opened by surface controlled wire line and used for miscible gas injection down the tubing string TS into the opened liquid formation LH as shown in FIGS. 9 & 11. The sliding sleeve SS can be opened to return solution gas pressure and volume to the in place crude oil in an original solution gas saturated liquid hydrocarbon formation LH if ever needed. It is also used in an older liquid hydrocarbon formation LH in which its crude oil is no longer mobile, to return solution gas by miscible gas injection from the surface down the tubing string TS to the in place crude oil to return its mobility and reduce its viscosity as needed, as seen in FIGS. 9 & 11.

In FIG. 6, on the tubing string TS is a packer P, with its gas pressure vent assembly GVA below, at the top of the liquid hydrocarbon formation LH, in the well bore open to the opened liquid hydrocarbon formation LH. The gas pressure vent assembly GVA contains a high pressure gas lift or chemical injection type valve which releases excessive gas pressure above its pressure setting from the well bore annulus A into the production tubing string TS to maintain a predetermined optimum recovery pressure in the well bore annulus A sufficiently lower than the liquid hydrocarbon formation LH pressure, but still above the formation's LH in place liquid hydrocarbon's bubble point pressure. The gas vent assembly GVA drops well bore pressure to a maximum predetermined level to allow maximum liquid hydrocarbon inflow from the liquid hydrocarbon formation LH while still staying above the in place crude oil's bubble point pressure for maximum liquid hydrocarbon recovery, while retaining miscible gas in solution within the in place recovering liquid hydrocarbons, thus maintaining them highly mobile and recoverable.

The gas vent assembly GVA, which can operate with available industry packers, comprises a gas lift valve type side pocket mandrel, open to the well bore below the packer P, thus opening the well bore annulus A below the packer P to the production tubing string TS. In the mandrel, on a tubing sub incorporating also the packer is its special high-pressure gas lift type valve which is inserted by wire line when needed into the mandrel. Special nitrogen-charged bellows within this high pressure valve are preset to a pre-calculated opening pressure. Thus high well bore pressure acting through the mandrel on the valve's internal bellows opens the valve's port into the production tubing TS, ejecting higher pressure gas building up above inflowing liquids from the top of the relatively small well bore annulus A volume, below the packer P into the tubing TS until pressure below the packer falls to the preset pressure and the valve closes.

The present invention's in place liquid hydrocarbon recovery to the surface seen in FIG. 6 works by the gas vent assembly's GVA maintained liquid hydrocarbon formation's LH well bore annulus A pressure differential through the Liquid Injector DOLI into the lower pressure production tubing string TS. Details of the invention's Liquid Injector DOLI in FIG. 6 are shown in FIGS. 3, 4 & 5, where reference is made to the present invention's pressure differential flow through the liquid injector's open double valve's main port SV described in FIGS. 3 & 4, and somewhat in FIG. 5. As the differential pressure driven liquid hydrocarbon passes the Liquid Injector's DOLI double shut off valve's SV main seat port, FIG. 3, No. 16, solution gas saturated liquid hydrocarbons are pressure flowed by this differential pressure as a liquid column toward the surface where only then solution gas breaks out, as the liquid hydrocarbons pass their bubble point pressure inside the lower pressure tubing string TS, to help flow the liquids upward through the wellhead WH tubing valve PV on out to the surface gathering system.

Depth restrictions of FIG. 6 are related to the system's chosen well bore operation pressures, i.e., 2,300 psi will easily flow produced gas saturated liquid hydrocarbons to surface in wells of approximately 6,000-ft. depths. However, in deeper wells, the production system shown later in FIGS. 8 through 12 are the preferred lift systems because of their artificial lift abilities. As seen in FIGS. 3 & 4, the invention's Liquid Injector valve's main port SV is adequate for higher volume oil producing wells. For example, the Liquid Injector's DOLI 11/16-in. main orifice valve SV opening into its 1-in. nominal 20-ft discharge pipe 13 will flow 13,400 bbl/day of 33° API crude through it at 1,000 psi differential. This main port SV valve flow capacity, when reduced to a 100-psi pressure differential for deeper or lower maintained bubble point pressure well bore annulus A wells, would flow 3,700 bbl/day. The Liquid Injector's DOLI main port valve SV flow capacity is also dependent on liquid characteristics at bottom hole conditions, with higher gravity crudes and condensates capable of higher flow rates. For deeper wells, the present invention's liquid hydrocarbon lift system is shown in FIGS. 8 through 12, with its added gas lift valve's gas lift injection into the tubing string TS artificial lift system. The present invention's systems disclosed to isolate and produce formations below upper open hydrocarbon producing formations are described and disclosed in FIGS. 11 and 12.

Figure 7:
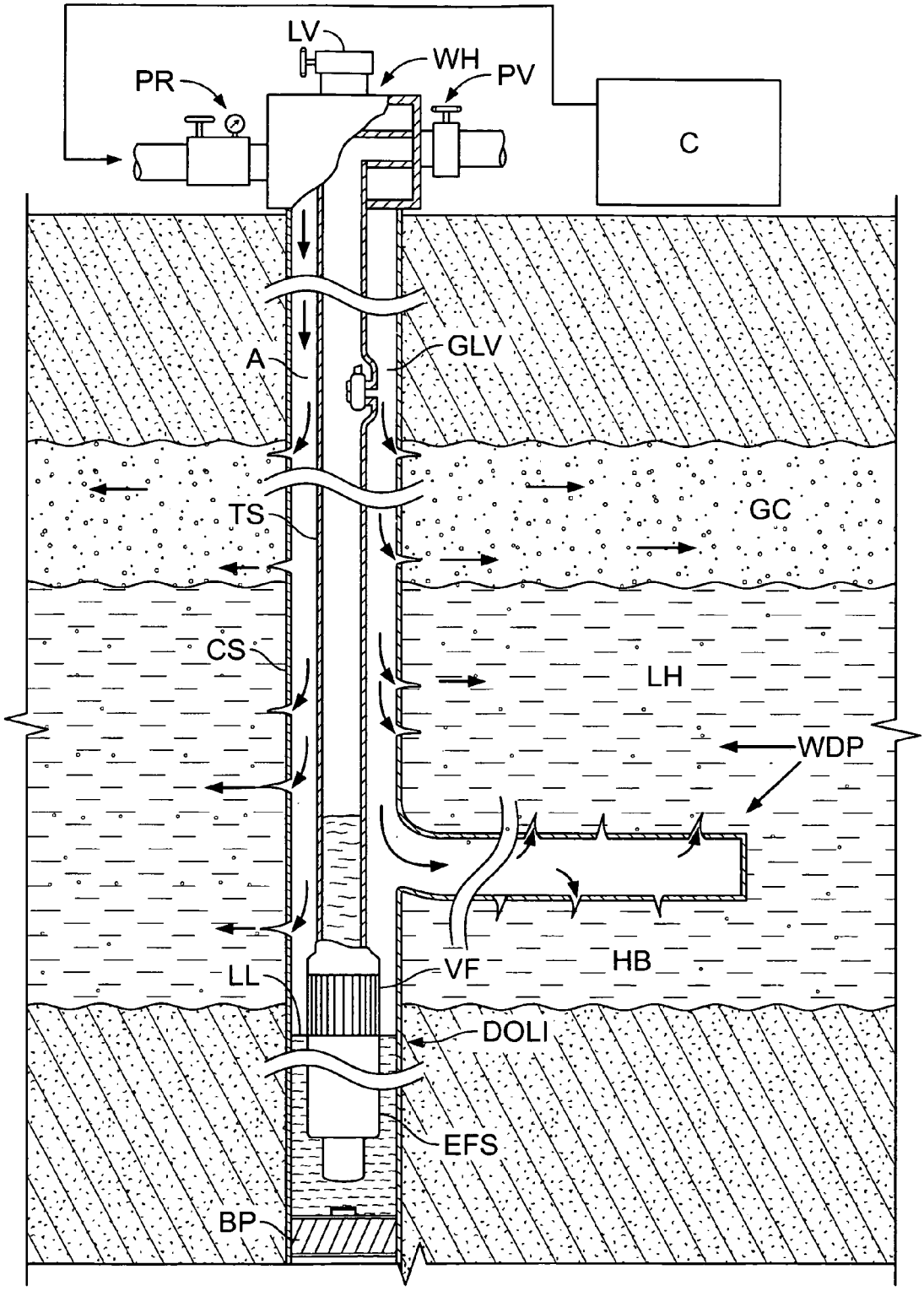
FIG. 7 illustrates the present invention's miscible gas injection procedure down the well's vertical wellbore annulus into perforated vertical and/or horizontal wellbores directly into the oil formation LH, where this miscible gas contacts in place oil at an optimum injection pressure, reaching an "equilibrium" state and entering into solution with that oil. The present invention's miscible gas injection procedure continues until optimum solution gas saturation is obtained in a predetermined oil formation area. The Liquid Injector DOLI with its extended float system EFS as needed, seen on the bottom of the tubing, along with one or more gas lift valves above it, will be used for oil recovery, after the miscible gas injection procedure is completed, when the well is converted to this same present invention's solution gas saturated crude recovery method. The liquid injector automatically closes to high gas injection pressure after its float empties of liquids during the gas injection procedure.

Miscible Gas Injection and Crude Oil Recovery by Maintained Optimum Well Bore Pressure FIG. 7 illustrates the present invention's miscible gas injection down an open well bore annulus A directly into a perforated and/or horizontally opened liquid hydrocarbon formation LH being supplied by the surface compressor's C compression through the Wellhead's WH gas pressure regulator valve PV. The tubing string TS complete with the invention's Liquid Injector DOLI with its extended float system EFS and one or more gas lift valves GLV is installed in the well bore prior to the invention's optimum pressure miscible gas injection procedure. The liquid hydrocarbon formation LH in FIG. 7 is without a gas cap, although the invention is also applied in a liquid hydrocarbon formation LH with a gas cap. In FIG. 7 and the following FIG. 8, the present invention's water drive pressure WDP is being applied from down structure on the in place liquid hydrocarbons in the liquid hydrocarbon formation LH, as described in FIGS. 1 & 2, to maintain them at a pre-calculated higher pressure, significantly above their final chosen optimum bubble point pressure. Thus, the invention's water drive pressure WDP is chosen to be at, and to create an optimum higher pressure, above the final chosen bubble point pressure on the liquid hydrocarbon formation LH for both the miscible gas injection and the liquid hydrocarbon recovery procedures. The invention's water drive pressure WDP can also be applied to be highly effective exclusively during the liquid hydrocarbon recovery procedure, with or without miscible gas injection, where more feasible.

When this water drive pressure WDP is applied during the miscible gas injection procedure, it benefits entry of the optimum pressure injected miscible gas entering into solution with the in place crude oil it contacts by creating notably higher pressure on this oil so that the miscible gas enters into solution easier, in order to reach the highest calculated solution gas saturation level and bubble point pressure sought for the formation LH. This applied water drive pressure WDP when used during the present invention's liquid hydrocarbon recovery procedures as shown in FIGS. 6, 8, 10 & 12, allows the well bore annulus A controlled gas pressure to be sufficiently lower than the liquid hydrocarbon formation's LH which is notable higher than its in place liquid hydrocarbon's final bubble point pressure.

The invention provides the novel recovery advantage that the liquid hydrocarbon formation's LH higher pressure being created by this water drive pressure WDP, allows for a substantial pressure drop into the well bore annulus A for total inflowing liquid hydrocarbons, but still remains just above their last injected or original highest bubble point pressure for total in place recovery, i.e., the well's operator can significantly drop well bore pressure, manually controlled at the wellhead WH pressure regulator valve PR, to a lower pressure to draw in liquid hydrocarbon flow from its opened liquid hydrocarbon formation LH, but still stay above its last bubble point pressure for accelerated and maximum in place recovery. As seen in FIG. 4, as liquid hydrocarbons enter the Liquid Injector's float 12 they are differential-pressure injected into an even lower pressure tubing string. Thus two pressure drops can be created by the present invention's application to the liquid hydrocarbon formation LH, first in the well bore annulus A dropping from the added pressure created by the water drive WDP, and the second through the Injector's DOLI float into the production tubing string TS. Bubble point pressure is always maintained in the present invention during total in place liquid hydrocarbon recovery until it's completely out of its formation, in fluid flow motion toward the surface in the tubing string TS, as seen in FIG. 8.

Figure 8:
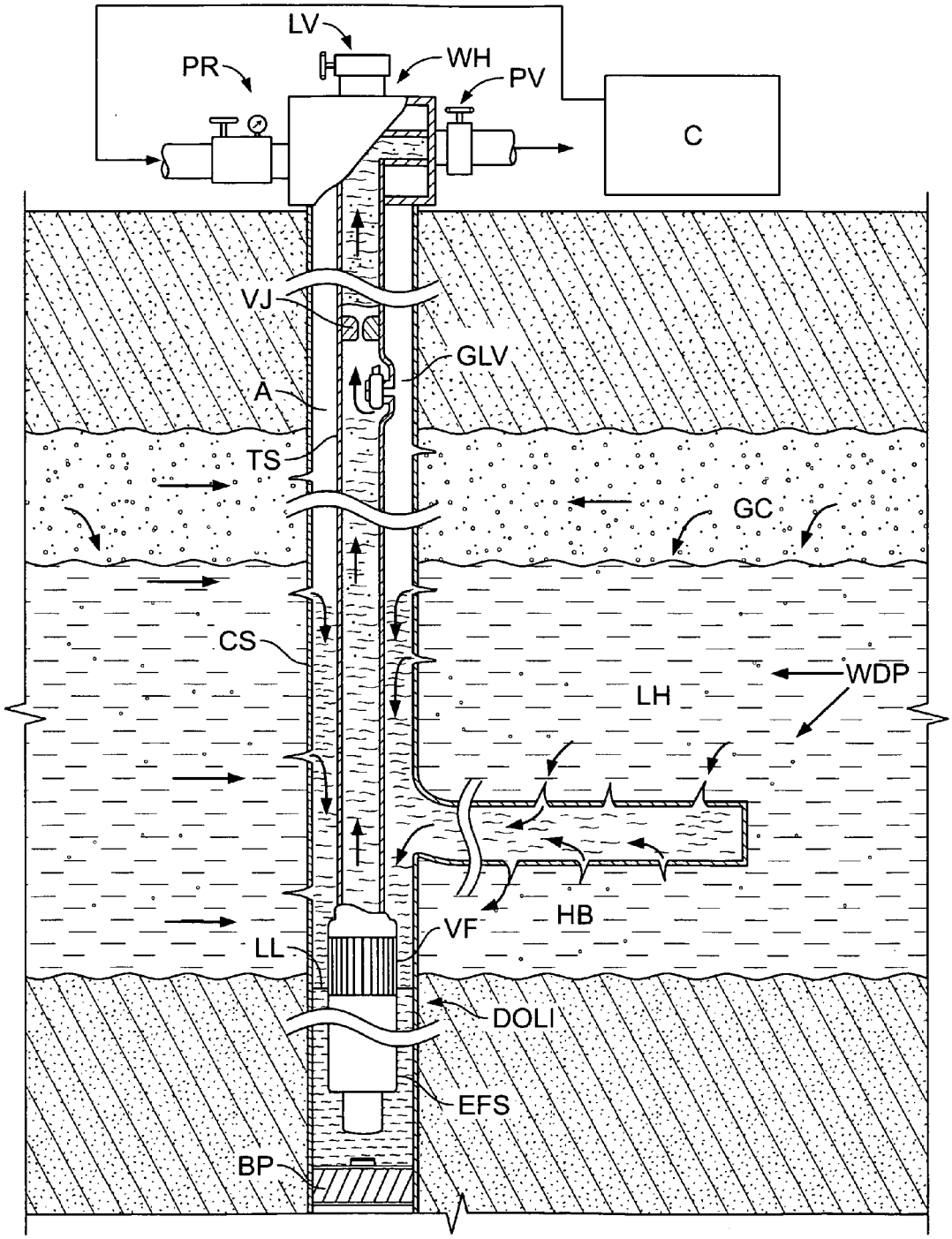
FIG. 8 illustrates two important oil & gas recovery applications of the present invention. This description is for oil recovery, and the description below (also FIG. 8) is for natural gas recovery. Here the oil recovery application shows the invention's miscible gas injection procedure of FIG. 7 converted to its solution gas saturated crude oil recovery procedure through the Liquid Injector into the production tubing. An optimum pressure drop, still above the oil's last highest existing bubble point pressure is created and controlled in the wellbore by the surface wellhead casing (pressure regulator) valve & pressure gauge PR, for drawing oil into the wellbore and directly into the Liquid Injector, where a significant second pressure drop (available to liquid only) is created when the Liquid Injector's float & valve opens to the production tubing, where pressure differential between wellbore and tubing, depending on depth, either pressure injects this recovering oil to surface, or above the first of one or more gas lift valves for complete gas lift to surface; an optional venturi jet shown above each gas lift valve enhances this gas lift, helping maintain its gas liquid interface to surface, as a type of stage lift method. The present invention's water drive pressure WDP is continually maintaining the oil within its formation LH, optimally above the oil's highest existing bubble point pressure, maintaining an optimum pressure drive mechanism, and the oil highly mobile during the entire solution gas saturated oil recovery procedure, for total in place crude oil recovery. The present invention's oil recovery system shown here with its optional water drive pressure WDP is also applied on original primary solution gas saturated oil in its primary reservoir, (with or without its miscible gas injection procedure as needed), to recover this oil above its bubble point pressure. Both these oil recovery procedures of the present invention are described in the "Detailed Description" while the present invention's relevant gas recovery application is described below.

The one or more gas lift valves GLV that are used for lifting the incoming liquid hydrocarbons recovering up through the Liquid Injector DOLI into the tubing string TS, as seen in FIG. 8, have no depth lifting limitations; however other industry available high-volume artificial lift systems, such as high-volume centrifugal pumps and rod pumps may be applied.

FIG. 7 also illustrates how the Liquid Injector DOLI on a tubing string TS with one or more gas lift valves can be installed in the vertical well bore, prior to the invention's miscible gas injection procedure. The well has been previously killed by pumping into its well bore annulus A, a special industry kill fluid compatible with the active liquid hydrocarbon formation LH. The Liquid Injector DOLI is set at an optimum low level in a deep rate hole, when present, above a bridge plug BP and below the liquid hydrocarbon formation LH for efficient liquid hydrocarbon drainage. Once the tubing with its downhole liquid recovery equipment as previously described is in the hole, the kill fluid is swabbed back through the wellhead's WH lubricator valve LV, and the miscible gas injection procedure can be started, by gas injection from the compressor C down the well bore annulus A. When the miscible gas injection procedure into the liquid hydrocarbon formation's LH in place crude oil is completed, the well is controlled and maintained at its wellhead WH annulus A pressure regulator PR valve under the invention's designed optimum operating well bore annulus A pressure just above its in place liquid hydrocarbon's bubble point.

In FIG. 7, unlike FIG. 6, well bore annulus A liquid hydrocarbon recovery pressure is controlled at the well's surface wellhead WH pressure regulator valve and gauge PR. This controlled well bore pressure drop after the higher pressure miscible gas injection procedure into the liquid hydrocarbon formation LH, will draw in the formation's LH incoming liquid hydrocarbons directly through the well bore into the Liquid Injector DOLI, where these liquids are differential-pressure injected up into the lower pressure production tubing string TS, as shown in FIG. 6 without artificial lift, and now in FIG. 8 with artificial lift. The invention's operating optimum well bore annulus A pressure always maintains an incoming liquid level LL of all incoming formation LH liquids at the Injector's DOLI screen filter VF, due to the pressure differential between the well bore annulus A and the tubing string TS. Thus, formation liquids enter directly from the formation LH, through the well bore into the Injector and are pressure injected by differential pressure toward the well's surface.

FIG. 8 illustrates the present invention's well bore liquid hydrocarbon formation LH production and recovery procedure after the invention's high-pressure miscible gas compression and injection procedure has fully saturated its in place crude oil with solution gas, as shown in FIG. 7, and is thereby completed. Also, this scenario can be an original-pressure liquid hydrocarbon formation LH with or without a gas cap, with original solution gas-saturated crude oil without prior miscible gas injection. In both producing scenarios shown in FIG. 8, the liquid hydrocarbon formation's LH pressure increase and maintenance is provided by down structure water injection, with the invention's water drive pressure WDP, as described in FIGS. 1 & 2.

In an original liquid hydrocarbon formation where substantial solution gas saturated crude and/or condensate is in place, the Liquid Injector DOLI, as seen in FIGS. 3 & 4 with a single-length float, or in FIG. 5 with an extended float system EFS, is installed in the well's lowest depth or rat hole below the liquid hydrocarbon formation, defined by a bridge plug BP or casing shoe. Original solution gas saturated liquid hydrocarbons are produced and recovered under the present invention's maintained optimum well bore annulus A pressure maintained at the well's wellhead WH pressure regulator valve PR, as described in FIG. 7. The present invention's increased recovery pressure on the liquid hydrocarbon formation LH, significantly above the in place liquid hydrocarbons highest original existing bubble point pressure, is created by the invention's down structure water injection. The vertical well bore is defined by the casing string CS or open hole opened into the hydrocarbon formation, or specially opened with both perforations and horizontal boreholes(s) HB as illustrated.

Liquid hydrocarbon LH production and recovery is obtained by pressure differential injecting liquid hydrocarbons through the Liquid Injector's opened float, as described and also seen in FIG. 4. The high pressure differential in some wells is high enough, as described in FIG. 6, to flow liquid hydrocarbons to the surface with assistance of free gas flow breaking out of solution in the tubing as the produced liquids fall below their bubble point pressure levels.

When the invention's original or final miscible gas injected liquid hydrocarbon formation's LH pressure, to its maintained well bore annulus A pressure, to its production tubing's TS pressure differential is not high enough to flow incoming liquids to the well's surface, an artificial lift system can be used as shown in FIG. 8, using one or more gas lift valves GLV with or without an optional venturi jet VJ combination to significantly increase gas lift efficiency. When sufficient well bore annulus A gas volume and pressure are not available from the liquid hydrocarbon formation LH, an outside source gas can be circulated into the well's well bore annulus A by compressor C, to supply necessary lift gas to gas lift incoming liquid hydrocarbon to the surface through the tubing string TS. Required outside lift gas pressure can be maintained in the well bore annulus A and controlled by the annulus pressure regulator PR and surface compressor.

Figure 10:
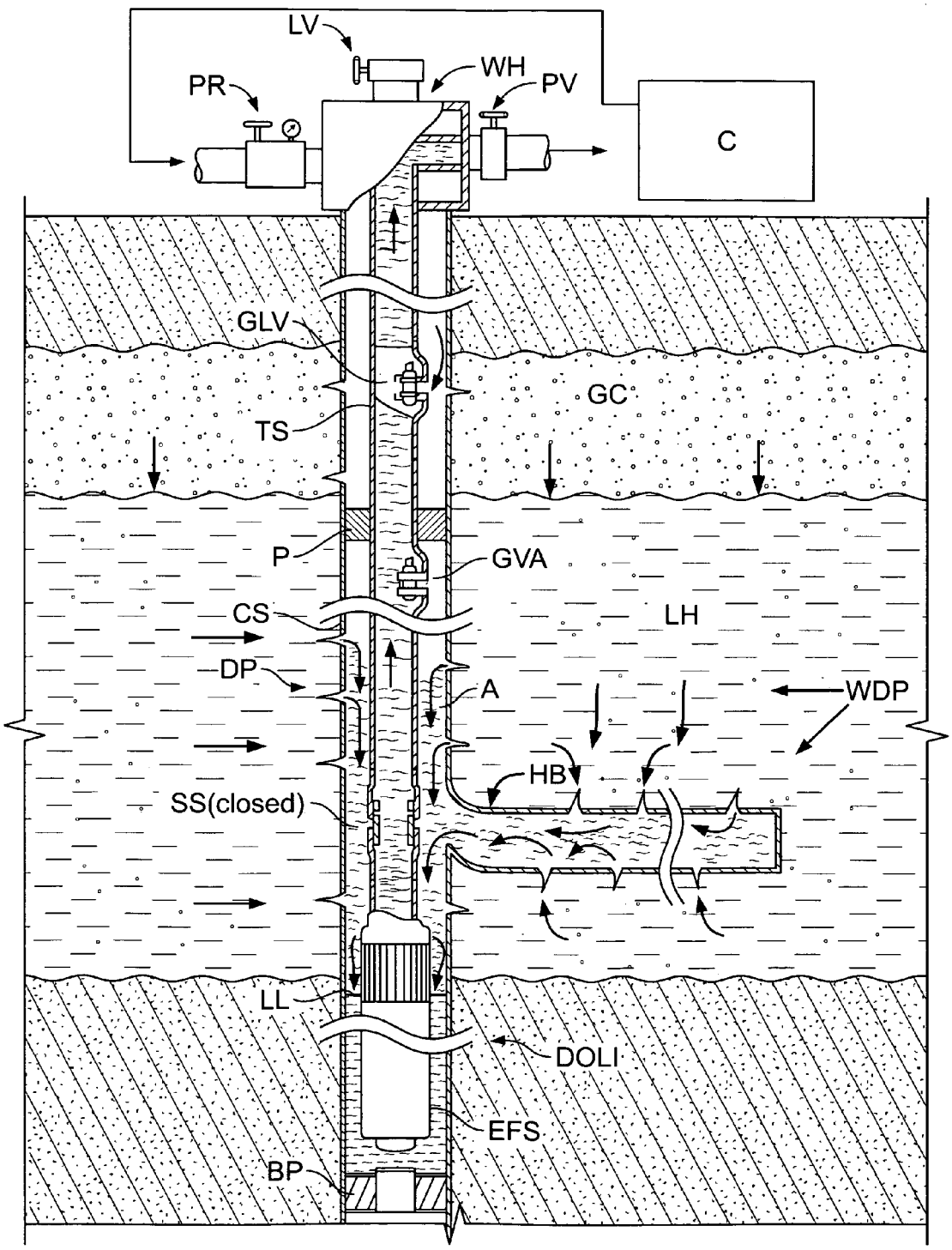
FIG. 10 illustrates the present invention's miscible gas injection phase of FIG. 9, after it has reached its maximum solution gas saturation level in a given formation area, and been converted to its solution gas saturated crude oil recovery, by surface compressor C halting the gas injection procedure, and maintaining equal gas pressure between tubing and wellbore annuluses to change the dummy gas lift GLV (DV) and gas vent assembly valves GVA (DV) for real valves. Then closing the sliding sleeve by wireline, so that the gas vent assembly releases & lowers wellbore gas pressure to its designed optimum, allows solution gas saturated crude oil to flow in as a liquid into the lower pressure wellbore and directly into the Liquid Injector DOLI at liquid level LL, where the Liquid Injector injects it up the tubing to be gas lifted to surface. Recovering crude is maintained above bubble point pressure by both the gas vent assembly and down structure water drive pressure, while gas cap pressure is also maintained by this water drive pressure WDP and the surface casing valve PR and optionally the compressor C. This casing annulus valve PR is used for upper or total wellbore pressure control as needed in all scenarios of the present invention.
Figure 12:
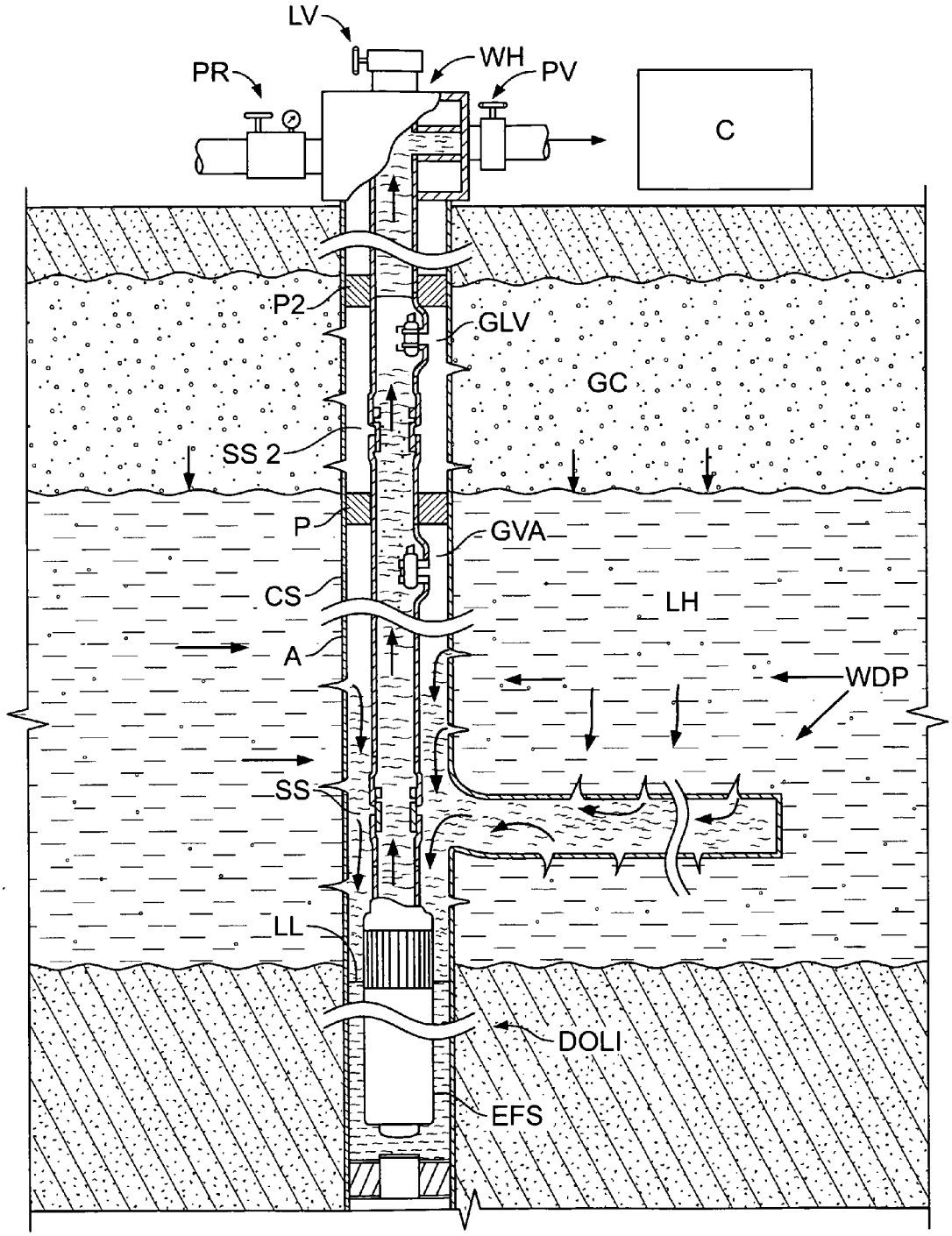
Figure 13:
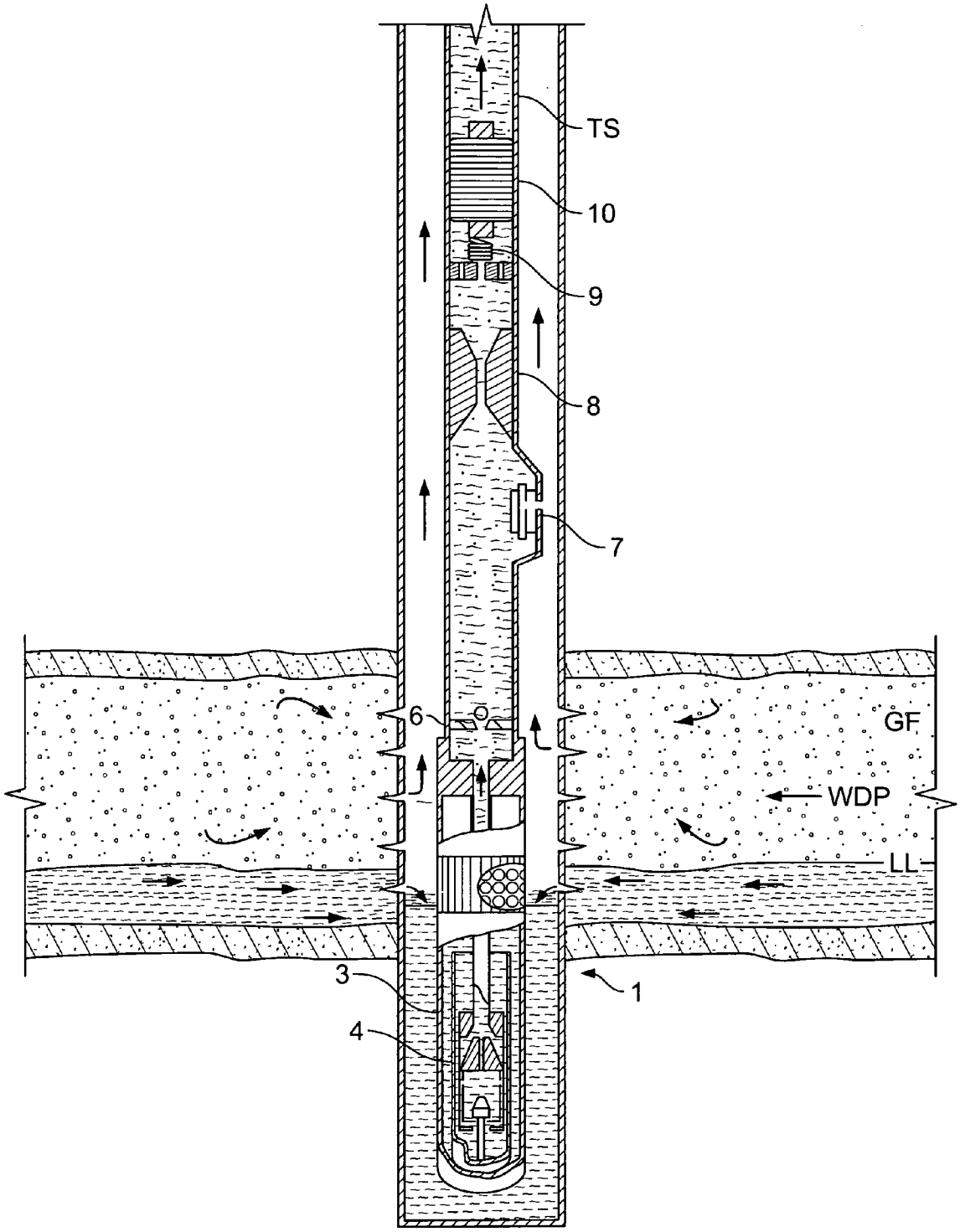
FIG. 13 illustrates the present invention's complete De-liquefying system for natural gas wells, which automatically removes all inflowing liquids entering the gas well's wellbore annulus adjacent to its open formation. Said liquids being restrictive to natural gas flow production, critically decreasing in its place gas recovery, (in some cases even killing a well,) are differential pressure injected through the present invention's liquid injector 3, into the production tubing string TS on to, or toward the surface while natural gas production flows free of these overburdening liquids wide-open and dry up through the well's wellbore annulus on to surface for sales. As explained in FIG. 4 and throughout the Speciation when formation to wellbore pressure is adequately high, incoming liquids can be completely lifted to surface through the liquid injector 3. by pressure differential alone. But when formation pressure is not high enough, then numerous types of effective industry available artificial lift can be applied by this present invention's natural gas well De-liquefying system, to lift these liquids completely to surface. Significantly improving on industry artificial lift systems for a highly efficient liquid lift operation, disclosed in FIG. 13, is the present inventions novel combination of one or more gas lift valves 7, (spaced out up the tubing string,) predominantly assisted by its unique addition of one plunger lift 10, (with optional only venturi tube 8 assist,) for exceptionally efficient and cost-effective artificial lift of liquids to the surface.

In all other liquid hydrocarbon recovery FIGS. 6, 10 & 12, but especially FIG. 8, in lower pressure liquid hydrocarbon formation LH well bore operations of the present invention, a rod pump or other pumping means can be alternatively employed. The rod pumping application is unique in that the well can be pumped down 24 hr/day to the Liquid Injector screen VF, as shown in FIGS. 3 & 4, to liquid level LL, without free gas entering the pump. The same advantage would apply to other types of downhole pumping applications. In FIGS. 7 & 8, the wellhead casing pressure regulator valve PR maintains well bore pressure which maintains gas in solution in the producing liquid hydrocarbons until they are out of the formation and into the tubing string TS, where only then can gas break out of solution. Hence, close to total in place liquid hydrocarbon recovery is achieved by application of the present invention.

Inflow of the original or newly solution gas injected and water drive pressure WDP driven and pressurized mobile crude oil with any accompanying condensate, will continue out of the formation LH through the Liquid Injector DOLI into the tubing string TS toward the surface, as columns of flowing liquids rise above the invention's one or more gas lift valves GLV and optional venturi jet VJ combinations, shown in FIG. 8. One or more venturi jets can be installed and made operational by wire line installation through the lubricator valve LV as needed. The invention's venturi jet addition assists with a beneficially added upward lifting jet type gas flow acceleration, and it maintains the required liquid/gas interface for a more efficient liquid lift, by preventing the gas lift valve's GLV injected gas flow from breaking through the producing liquid hydrocarbons. The gas lift system injects required but minimum lift gas as needed, producing the liquid hydrocarbon formation's LH total inflowing liquid hydrocarbons on to surface in all depth wells through the wellhead's WH production valve PV, without well depth limitations. As mentioned, this scenario will also produce without artificial lift if the invention's maintained well bore pressure can flow its hydrocarbon liquids to surface. Thus, the present invention's well bore production and recovery system is shown aided by its added down structure water drive pressure WDP, which allows the operator to optionally provide a substantial drop in pressure into the well bore annulus A to encourage liquid hydrocarbon flow out of the formation LH into the well bore and on to surface. And, as stated, FIG. 8 can be applied in a well with original solution gas saturated liquid hydrocarbons, or after the miscible gas injection process of FIG. 7.

FIG. 9 illustrates the present invention's miscible gas compression and injection system with its downhole recovery equipment preinstalled on a tubing string TS in the well bore annulus A prior to the invention's miscible gas injection procedure into its liquid hydrocarbon formation LH. Shown from the well's surface wellhead WH to the well bore's bottom established by bridge plug BP, is the compressor C injecting optimum pressure natural or other miscible gas through the well's surface wellhead WH production tubing valve PV into the tubing string TS. The surface injected miscible gas passes down the tubing string, by one or more gas lift valve mandrels which are pressure sealed with dummy gas lift valves GLV (DV), and on by the invention's packer P and its one or more gas vent assemblies GVA each also sealed with a dummy valve DV. The surface compressor C is injecting optimum pressure miscible gas through the open sliding sleeve SS, where the gas is compressed through the casing string CS perforations and/or one or more optional, perforated horizontal borehole(s) HB into the open liquid hydrocarbon formation LH. As the compressed optimum pressure miscible gas is injected deep into the liquid hydrocarbon formation LH, it contacts the in place crude oil, where it reaches a predetermined optimum pressure and enters into solution with the in place oil. Injected miscible gas entering into solution with the in place oil returns the oil's highly valuable solution gas, thereby increasing its mobility, and reducing its viscosity, making it highly fluid and recoverable.

This miscible gas injection process is significantly benefited by the present invention's down structure injected water drive pressure WDP on the liquid hydrocarbon LH as it increases its in place crude oil's pressure to a predetermined significantly higher pressure above the oil's final bubble point pressure sought by the invention's miscible gas injection procedure. This novel, substantially higher pressure on the in place crude oil above its final bubble point pressure allows a notable drop of pressure into the well bore, while still remaining above its final bubble point pressure when it is recovered. The present invention's injected solution gas procedure into the in place oil with its novel increased down structure water drive pressure WDP on this in place oil makes non-producible oil or hard-to-produce oil, highly producible and increases its total in place recoverability, and/or accelerates its recoverability, depending on its gravity and/or degree of or lack of original solution gas. The invention's miscible gas injection with water drive pressure WDP significantly benefits the newly solution gas saturated oil's recoverability by substantially helping draw it into the well bore for final pressure differential injection through the Liquid Injector DOLI, on into the production tubing string TS toward the well's surface.

FIG. 9 also illustrates a gas cap GC at the top of the liquid hydrocarbon formation, when present. Both the liquid hydrocarbon formation's LH gas cap GC pressure and its upper well bore annulus gas pressure are controlled and monitored by the well's surface wellhead WH pressure regulating valve PR. Optionally, miscible or non-miscible gas can be injected from compressor C through the surface wellhead WH pressure regulator valve PR into the well's upper well bore into the liquid hydrocarbon formation's LH gas cap GC above packer P, to build up optimum gas cap pressure when feasible and needed. When feasible, increased gas cap gas pressure can additionally benefit the present invention's injected water drive pressure WDP on its miscible gas injection MGI into the liquid hydrocarbon formation LH below its gas cap GC, as seen schematically in FIG. 2; to further benefit the needed return of solution gas and super enhance liquid hydrocarbon recovery.

On the bottom of the tubing string TS below the open sliding sleeve SS is the liquid Injector DOLI, with its single length float, as seen in FIG. 3, or its optimum length extended float system EFS, as needed and seen in FIG. 5. The Liquid Injector's DOLI of FIG. 9 outer housing 10, as seen in FIGS. 3 & 4 has been preloaded on the surface prior to its installation with water-based brine, for maximum single or extended float EFS operating weight and buoyancy, for both the miscible gas injection and liquid hydrocarbon recovery operations.

Reservoir engineering studies and modeling of the liquid hydrocarbon formation LH can help determine its maximum solution gas saturation level, and when it is estimated to be reached and completed. The invention's conversion in FIG. 9 from gas injection to liquid hydrocarbon production and recovery begins by compressor C temporarily pressuring up through the wellhead's WH production valve PV into the tubing string TS to equalize gas pressure between tubing string TS and lower well bore annulus to its liquid hydrocarbon formation LH with the sliding sleeve SS open to operate a wire line through the well's wellhead WH surface lubricator valve LV. The wire line removes the one or more dummy valves from their one or more "gas valve assembly" gas lift valve type mandrels GVA (DV). Preset extra high pressure operating gas lift or chemical injection type valves usually with high pressure nitrogen charged bellows, are then installed into the mandrel or mandrels GVA by the wire line, as seen in FIG. 10.

The upper well bore annulus of FIG. 9 is also pressured up from compressor C to equalize its gas pressure through the wellhead production valve PV down the tubing string TS with the sliding sleeve SS on the tubing below closed, and through the well's wellhead WH surface pressure regulator valve PR on the upper well bore annulus, to temporarily maintain equal pressure on its gas cap GC and the tubing string TS for the dummy valve to live valve conversion. Once gas pressure is equalized, the same wire line removes the one or more dummy valves from their gas lift valve mandrels GLV (DV). One or more preset live operating gas lift valves GLV are then installed into each mandrel by the wire line.

As seen in following FIG. 10, with the sliding sleeve SS closed, the well then begins its complete production and recovery of its newly maximum solution gas saturated crude oil with any accompanying condensate (liquid hydrocarbons) by the surface compressor C gradually reducing its gas compression on the open liquid hydrocarbon formation LH. Liquid hydrocarbons then flow into the well bore annulus A and into the Liquid Injector DOLI where they are differential pressure injected by the Injector DOLI, upward into the production tubing string toward the surface. Total production and recovery of the in place solution gas saturated liquid hydrocarbons is controlled by the present invention's one or more gas vent assemblies GVA below packer P, which drop well bore pressure, but maintain these inflowing liquid hydrocarbons above their last and highest bubble point pressure, as seen in FIG. 10. The one or more gas vent assemblies can optimally drop the well bore annulus A pressure by their valve's presetting to a substantially lower pressure, which significantly benefits inflowing liquid hydrocarbon recovery by drawing in these valuable hydrocarbon fluids from the higher pressure liquid hydrocarbon formation LH for production through the Liquid Injector DOLI. This present invention's lower well bore pressure, is essential and novel to be substantially lower than the liquid hydrocarbon formation's LH significantly higher pressure over its in place liquid hydrocarbon's final and highest bubble point pressure. The invention's novel and critical higher liquid hydrocarbon formation LH pressure is created by its down structure water drive pressure WPD. Thus, the present invention's critically important lower well bore pressure which draws in liquid hydrocarbon flow from the higher pressure liquid hydrocarbon formation LH is notably gained by the distinct advantage of the invention's added water drive pressure WDP in FIGS. 9 & 10, as described in FIGS. 1 & 2.

FIG. 10 illustrates FIG. 9 now converted for liquid hydrocarbon recovery by showing the present invention's downhole Liquid Injector DOLI with the well's pre-described artificial lift equipment producing and recovering solution gas saturated crude oil and any accompanying condensate (liquid hydrocarbons) into the invention's provided lower pressure tubing string TS, after its miscible gas injection procedure described in FIG. 9, and its downhole gas injection to liquid hydrocarbon recovery equipment conversions are completed, and the well is brought on to production. In FIG. 10, liquid hydrocarbons are seen readily flowing from the invention's substantially higher pressure deep perforated DP, open hole, and/or horizontally drilled opened liquid hydrocarbon formation LH into its maintained lower pressure well bore annulus A, which substantially encourages liquid hydrocarbon formation LH liquid inflow. This needed well bore annulus A lower pressure drop is created and controlled by the invention's unique gas vent assembly GVA, which also maintains this controlled well bore annulus A lower pressure above the incoming liquid hydrocarbon's maintained last and highest bubble point pressure by venting any excess gas pressure below packer P over its high pressure gas lift type valve's optimum pressure setting into the production tubing string TS. The present invention's water drive pressure WDP seen in FIGS. 9 & 10 is being injected down structure to increase and maintain pressure on the in place liquid hydrocarbons notably above their last and highest selected bubble point pressure, see FIGS. 1 & 2, which creates a needed and notably beneficial pressure differential between the well bore and tubing string TS, that better enables them to readily flow and be recovered as pure liquids from their higher pressure liquid hydrocarbon formation LH into the lowered pressure well bore annulus A.

Seen in FIG. 10, these inflowing solution gas saturated liquid hydrocarbons flow by differential pressure from the higher pressure liquid hydrocarbon formation LH into the lower pressure well bore annulus A on into the Liquid Injector DOLI, where the Injector, by an even higher differential pressure, injects them into the significantly lower pressure production tubing string TS, where they are gas lifted by the one or more tubing fluid pressure operated gas lift valves GLV on out the wellhead WH production valve PV at the surface. The Liquid Injector's DOLI flow rates are capable of flowing excessively high volumes of liquid hydrocarbons as described in FIGS. 3 & 4. In FIG. 10, the invention's created differential pressure from the well's well bore annulus A to tubing string TS, substantially increases formation LH incoming liquid flow rates through the Liquid Injector DOLI with its extended float system EFS, into the lower pressure production tubing string TS because the differential pressure is even higher due to the gas lift valve operation continually and automatically removing high pressure gas, including that refused by the DOLI, on the liquid in the tubing string TS. In FIG. 10 and all recovery FIGS. 6, 8, 10 & 12, the well's liquid hydrocarbon formation's LH high volume solution gas saturated liquid hydrocarbon recovery always maintains a consistent liquid level LL at the Liquid Injector's inlet screen due to the invention's specially created high pressure differential from well bore annulus A to production tubing string TS. Also gas breaking out of solution in upward flowing producing liquid hydrocarbons in the tubing string TS assists the liquid lift in all the invention's recovery scenarios.

The well illustrated in FIG. 10 can also be a downhole system of the present invention producing an original-pressure well with original solution gas saturated crude oil and/or condensate with the invention's added benefit of its down structure water drive pressure WDP, but without any prior miscible gas injection into the liquid hydrocarbon formation LH as described in FIG. 9. In both applications, the present invention can later use the miscible gas injection procedure described in FIG. 9, if required to re-saturate or super saturate more crude oil; however it is likely that it will not be usually necessary. In some liquid hydrocarbon formations LH when feasible, shallower depth wells or higher pressure wells can pressure-differential lift their inflowing liquid hydrocarbons without artificial lift assist due to the added pressure created by the present invention's added water drive pressure WDP and/or benefited by an optional higher related setting of the gas vent assembly GVA as seen in FIG. 6.

Once the total in place solution gas saturated crude oil and/or condensate is recovered from the well site's given recovery area in the liquid hydrocarbon formation LH, other miscible gas injection/recovery well sites can be optionally chosen in the overall field reservoir, if not already under such recovery operations as pre-programmed for the entire reservoir's in place liquid hydrocarbons, thereby recovering close to total in place liquid hydrocarbons within the reservoir or selected field area.

FIGS. 11 and 12, as illustrated, are identical to FIGS. 9 & 10, respectively except for addition of an upper packer P2 and upper sliding sleeve SS2. The upper packer P2 in both FIGS. 11 & 12 remains in its secured location to isolate the chosen liquid hydrocarbon formation's LH gas cap GC from one or more open upper formations in the well's well bore annulus A. In this embodiment, the upper sliding sleeve SS2 is used to optionally and separately inject miscible or non-miscible gas through the tubing string TS into the gas cap GC as needed for increasing pressure and/or optimum gas cap GC pressure maintenance, and/or for circulating lift gas for the well's gas lift valve GLV operations when need for lifting incoming liquid hydrocarbons during this well's recovery operation as seen in FIG. 12. During the separate gas cap injection procedure, the bottom sliding sleeve SS can be closed or open as needed depending on the well's miscible or non miscible gas injection plan into the gas cap described above. During both the miscible gas injection directly into the liquid hydrocarbon formation LH and/or the gas cap injection procedures in FIG. 11, like FIG. 9, dummy valves are in place in the one or more gas lift valve mandrels GLV (DV) and in the gas vent assembly mandrel GVA (DV) below packer P as removable plugs to seal them off during gas injection procedures.

Miscible gas is injected and compressed by surface compressor C down the tubing string TS through the open bottom sliding sleeve SS into the opened liquid hydrocarbon formation LH, where it contacts the in place crude oil at the invention's preplanned optimum volume and pressure compression rate to enter into solution with it. When optimum solution gas saturation within the in place crude oil contacted by the miscible gas is obtained in the liquid hydrocarbon formation LH, optionally, miscible or non-miscible gas can be injected down the tubing string TS into the opened gas cap GC from compressor C by wire line opening the upper sliding sleeve SS2 and closing lower sliding sleeve SS. Arrows indicate injected gas penetration in the opened gas cap GC and arrows pointing downward indicate downward gas cap GC pressure drive on the liquid hydrocarbon formation's LH in place liquid hydrocarbons for additional overhead recovery pressure to assist the water drive pressure WDP force moving solution gas saturated liquid hydrocarbons toward the well bore's lower pressure drop for super accelerated production and recovery. Both gas cap GC pressure downward drive and water drive pressure WDP maintain a total pressure on the in place liquid hydrocarbons significantly above their predetermined newly sought bubble point pressure. Alternatively, both gas cap GC and liquid hydrocarbon formation LH can be injected into at the same time by compressor C compressing miscible gas down the tubing string through both open sliding sleeves. In both FIGS. 11 and 12, injected water drive pressure from the invention's one or more down-structure water injection wells as described in FIGS. 1 & 2 and preceding FIGS. 9 & 10 provides a recovery pressure driving force on the up-structure liquid hydrocarbon formation's in place liquid hydrocarbons substantially above their selected highest bubble point pressure. During the invention's liquid hydrocarbon recovery procedure seen in FIG. 12, solution gas saturated liquid hydrocarbons are produced from the formation at an enhanced rate as indicated by the water drive pressure WDP arrows moving toward the opened well bore area.

FIG. 12, like FIG. 10, illustrates the present invention's solution gas saturated liquid hydrocarbon production and recovery procedure in an opened original liquid hydrocarbon formation LH with its gas cap GC, or after the invention's optimum pressure miscible gas injection into the liquid hydrocarbon formation's LH in place crude oil, as described in FIG. 11. In both of these type applications, the invention's downhole production equipment is located below upper open formations which are isolated by a second packer P2. FIG. 12 like FIGS. 6, 7 & 10, optimally drops well bore pressure which draws in, to produce and recover, total in place solution gas saturated liquid hydrocarbons from deep within the formation LH as pure liquids above their highest bubble point pressure. In place liquid hydrocarbons flow from the well's recovery area into the lower well bore annulus A and through the float operated Liquid Injector DOLI (with its single or extended float system EFS) and up the tubing string TS, where these liquids are then gas lifted by the one or more tubing fluid operated gas lift valves GLV on to the surface. In FIG. 12, both the upper and lower sliding sleeves are closed, and the dummy valves in the one or more gas vent assemblies GVA(DV) below packer P and the one or more gas lift valves GLV (DV) as seen in FIG. 11 have been replaced with live operating gas lift type and gas lift valves, respectively.

After the total solution gas saturated liquid hydrocarbons have been recovered, the upper sliding sleeve SS2 can be opened to produce the gas cap's GC gas up the tubing string to surface, or recycle the formation's gas for re-injection into another chosen crude oil formation. During this gas recovery process, dummy valves as seen in FIG. 11 are reinstalled in the one or more gas lift valve mandrels GLV to prepare the tubing string for controlled gas recovery. Reservoir engineering studies and reservoir modeling will play an important role in proper application of the present invention in given liquid hydrocarbon reservoirs and field areas.

Another principal feature of all the present invention's disclosed novel liquid hydrocarbon production and recovery procedures shown in FIGS. 6 through 12 is that positively no large or even significant volumes of free gas are ever produced with the recovering liquid hydrocarbons except for the relatively smaller amounts of gas lift gas and gas breaking out of solution, both of which are promptly re-cycled back into the well or its field gathering system. Absolutely no other liquid hydrocarbon recovery technology in today's world oil industry can do this. No longer being mandatory to produce large volumes of liquid hydrocarbon formation gas with producing crude oil in the world's numerous flowing oil fields from oil reservoirs globally will notably decline the world oil industry's long standing practice of wasteful and seriously harmful burning of gas to the earth's atmosphere, which is highly common outside the U.S. and in many third world nations. These major worldwide environmental benefits of the present invention's application will significantly help decline the world's presently critically increasing global warming problem created by flaring large volumes of gas to the earth's atmosphere. The present invention's distinct advantage of not producing gas in the world's flowing oil wells will also significantly help eliminate dangerous and environmentally destructive oil well blow outs caused by producing oil with large volumes of free gas flow on both land and offshore.

Application of the present invention according to the foregoing disclosure where feasible in primary and secondary crude oil recovery operations world wide will recover close to the total original or remaining in place crude oil, which is well over the industry's extremely costly and hard to obtain present highest levels of 40% or less original oil in place. The major feature is the present invention's novel process of notably increasing liquid hydrocarbon formation pressure above bubble point pressures by down-structure water drive pressure on up structure in place liquid hydrocarbons, then optionally injecting miscible gas into in place crude oil lacking solution gas and pressure, and producing these solution gas saturated in place liquid hydrocarbons into a lower pressure well bore above their bubble point pressure, to then inject them into an even lower pressure tubing string where they are produced on to the surface, will substantially increase liquid hydrocarbon recovery world wide. The present invention's application where feasible according to the foregoing disclosure, to notably extend the worlds' present oil recovery peak to produce and recover close to the world's total in place recoverable crude oil and condensate, has thus been disclosed.

The foregoing disclosures and description of the present invention are thus explanatory thereof. It will be appreciated by those skilled in the art that various changes in the size shape and materials; as well as in the details of the illustrated construction and systems, combination of features, and methods as discussed herein, may be made without departing from this invention. Although the invention has thus been described in detail for various embodiments, it should be understood that this explanation is for illustration, and the invention is not limited to these embodiments. Modifications to the system and methods described herein will be apparent to those skilled in the art in view of this disclosure. Such modifications will be made without departing from the invention, which is defined by the following claims.

The invention claimed is:

1. A method for liquid hydrocarbon recovery from an intermediate to a higher pressure downhole liquid hydrocarbon formation and through a production tubing string in a wellbore, the method comprising:

providing a vertical wellbore annulus within an opened liquid hydrocarbon formation, said liquid hydrocarbon formation having solution gas saturated crude oil;

providing a production tubing string down the vertical wellbore near or below the opened liquid hydrocarbon formation, with a liquid injector on the bottom of said production tubing string, for preventing gasses from passing into the production tubing string, said liquid injector for producing opened liquid hydrocarbon formation liquid inflow;

providing a surface wellhead with a pressure control valve and a pressure gauge for controlling a selected optimum wellbore annulus to open liquid hydrocarbon formation liquid hydrocarbon recovery pressure;

producing the opened liquid hydrocarbon formation liquid inflow through said liquid injector into the production tubing string completely on to the surface by wellbore annulus to production tubing string pressure differential alone; and maintaining the opened liquid hydrocarbon formation under controlled optimum wellbore annulus to liquid hydrocarbon formation pressures above that of the in place crude oil's bubble point pressure, with the surface wellhead pressure control valve thereof, through the entire liquid hydrocarbon production and recovery process.

2. The method as defined in claim 1, wherein in lower pressure liquid hydrocarbon formations artificial lift is added, further comprising:

providing one or more gas lift valves optimally spaced up hole on the production tubing string above said liquid injector to help lift liquids to the surface, said gas lift valves for selectively injecting wellbore annulus gasses into the production tubing string for lifting columns of incoming liquids through the production tubing string to the surface;

providing a plunger catcher on the surface wellhead, and a plunger lift on a plunger stop directly above the bottom gas lift valve inside the production tubing string for creating a more efficient gas to liquid interface and sweeping action when the bottom gas lift valve opens, by providing a solid piston type plunger to help lift the incoming liquids on to the surface; and producing the opened liquid hydrocarbon formation liquid inflow through said liquid injector into the production tubing string by wellbore annulus to said tubing string pressure differential, wherein selectively injected gas from gas lift valves lifts a plunger below said liquid inflow to lift said liquid inflow on to the surface, whereby recovering total incoming liquids is completed to surface by a highly efficient liquid lift.

3. The method as defined in claim 2, wherein the method heretofore of lifting the liquid inflow by wellbore annulus to tubing string pressure differential, with artificial lift assist is improved by eliminating the plunger lift for higher incoming liquid volume, further comprising:

removing the plunger by catching it inside the surface wellhead plunger catcher when incoming liquid volume into the tubing string surpasses said plunger's ability to travel up and down, and returning to the gas lift valve operation, whereby improving the liquid injector's pressure differential high volume liquid lift by assisting said liquid injector's liquid lift up hole through stage lift gas flowing the incoming high volume of liquids completely on to the surface.

4. The method as defined in claim 1, wherein the method of producing the opened liquid hydrocarbon formation liquid inflow through the liquid injector into the production tubing string by wellbore annulus to production tubing string pressure differential is substantially improved to provide enhanced liquid hydrocarbon recovery, further comprising:

injecting water down structure into the liquid hydrocarbon formation as a means for increasing pressure within the liquid hydrocarbon formation, by means of compressing the up structure in place liquid hydrocarbons, whereby creating a selected higher pressure on said in place liquid hydrocarbons for pressurized enhanced recovery of said in place liquid hydrocarbons, thereby obtaining total in place liquid hydrocarbon recovery.

5. The method as defined in claim 1, wherein the liquid injector is improved for exceptionally higher pressure and volume production and recovery of liquid hydrocarbons, further comprising;

lengthening the liquid injector's outside jacket, screen and liquid responsive vertical float, such that said float is substantially extended in cylinder length, for adding float opening weight with increased float closing buoyancy, for opening and closing said injector's double shutoff valve's pilot valve, at all variable maintained high operating liquid hydrocarbon recovery pressure differentials between the wellbore annulus and the production tubing string, for ongoing increased recovery of liquid hydrocarbons.

6. The method as defined in claim 1, further comprising:

providing the surface wellhead with its pressure control valve and its pressure gauge for controlling a selected optimum wellbore annulus to open liquid hydrocarbon formation pressure in liquid hydrocarbon formations containing primarily condensate for optimum pressure recovery through the liquid injector on into the production tubing string to surface, for total in place recovery of condensate.

7. The method as defined in claim 1, further comprising:

providing the vertical wellbore annulus with a horizontal wellbore opened into the liquid hydrocarbon formation, said horizontal wellbore exposed to the liquid hydrocarbon formation's in place liquid hydrocarbons, for increased exposure area to the in place liquid hydrocarbons for increased volume area recovery of liquid hydrocarbons.

8. A method for natural gas recovery from an average to higher pressure downhole natural gas formation through a wellbore to the surface, the method comprising:

providing a vertical wellbore annulus within an opened natural gas formation, said natural gas formation having in place natural gas;

providing a production tubing string down the vertical wellbore by or below the opened natural gas formation, with a liquid injector tool on the bottom of the production tubing string, for preventing gasses from passing into the production tubing string, said liquid injector for producing any opened natural gas formation liquid influx into said production tubing string and on to or toward the surface by wellbore annulus to production tubing string pressure differential; and providing the vertical wellbore annulus with a surface wellhead pressure control valve and a pressure gauge for producing gas flow to the surface, said wellhead pressure control valve thereof for maintaining optimum wellbore annulus pressure to lift incoming liquids through the liquid injector and into the production tubing string on to the surface, by wellbore annulus to production tubing string pressure differential, and for producing gas flow recovery throughout the entire natural gas production and recovery procedure.

9. The method as defined in claim 8, wherein the wellbore annulus to production tubing string pressure differential through the liquid injector alone cannot lift incoming liquids completely to the surface, and artificial lift is added, further comprising:

providing one or more gas lift valves optimally spaced up hole on the production tubing string above said liquid injector, said gas lift valves for selectively injecting wellbore annulus gasses into the production tubing string for lifting columns of incoming liquids through the production tubing string on to the surface; and providing a plunger catcher on the surface wellhead, and a plunger lift on a plunger stop directly above the bottom gas lift valve inside the production tubing string for creating a more efficient gas to liquid interface and sweeping action when the bottom gas lift valve opens, by providing a solid interface and sweeping action when the bottom gas lift valve opens, by providing a solid piston plunger to help lift the incoming liquids on to the surface, and removing said plunger by catching it inside the surface wellhead plunger catcher when incoming liquid volume into the tubing string surpasses its ability to travel up and down, and returning to the gas lift valve operation to assist the liquid injector's pressure differential liquid lift by helping stage gas flow the incoming high volume of liquids onto the surface, whereby, assisting said liquid injector's pressure differential liquid lift up through the production tubing string toward the surface.

10. The method as defined in claim 8, wherein pressure is substantially increased on in place natural gas and any in place or forming liquid hydrocarbons within the natural gas formation void of invading water influx, for enhanced gas and liquid hydrocarbon recovery thereof, further comprising:

injecting water down structure into the natural gas formation that contains in place natural gas alone, or along with any incoming or forming liquid hydrocarbons as a means for increasing said in place natural gas up to a selected higher optimum recovery pressure by means of compressing the up structure natural gas formation's in place natural gas above the natural gas's dew point pressure to prevent condensate blockage, thereby benefiting the natural gas recovery procedure;

flowing any incoming liquid hydrocarbons through the liquid injector into the production tubing string and on to the surface by wellbore annulus to production tubing string pressure differential and artificial lift as needed, flowing gas production up the wellbore annulus to the surface gas sales line, thereby increasing up to total in place natural gas recovery, and up to total in place liquid hydrocarbons recovery.

11. The method as defined in claim 10, wherein the method for natural gas recovery by injecting water down structure is improved for crude oil recovery in natural gas formations having in place crude oil, further comprising;

injecting water down structure into the natural gas formation that contains natural gas and in place crude oil, thereby increasing pressure on said natural gas and in place crude oil and any accompanying condensate to accelerate the natural gas and in place crude oil and any accompanying condensates' flow to or toward the surface;

flowing said crude oil and any accompanying condensate through the liquid injector into the production tubing string and on to the surface by wellbore annulus to production tubing string pressure differential and artificial lift as needed, flowing gas production up the wellbore annulus to the surface gas sales line;

providing the surface wellhead pressure control valve and pressure gauge for maintaining an optimum gas and crude oil recovery pressure on the vertical wellbore to the natural gas formation, said natural gas formation having substantial in place crude oil, said surface wellhead pressure control valve thereof for maintaining said optimum gas and crude oil recovery pressure above the in place crude oil's critical bubble point pressure, for total in place crude oil recovery through the liquid injector and into the production tubing string by wellbore annulus to production tubing string pressure differential with optional artificial lift assist to the surface;

producing gas flow up the vertical wellbore to the surface gas sales line throughout the entire natural gas production and recovery procedure; and producing crude oil recovery through the liquid injector and into the production tubing string to the surface, thereby recovering total in place crude oil by the vertical wellbore to the gas formation gas pressure maintained above said crude oil's bubble point pressure, and by injecting water down structure in the natural gas formation as a means for creating an oil compressing pressure driving force along with the compressing natural gas force to move the oil out of the natural gas formation and to the surface, whereby producing total in place oil recovery through the liquid injector and on to the surface, whereby producing total in place oil recovery through the liquid injector and on to the surface, and ultimately producing total in place natural gas recovery up the wellbore annulus by optimum water drive pressure and by optimum surface controlled wellbore annulus to production tubing string pressure differentials.

12. The method as defined in claim 8, wherein the liquid injector tool is improved for higher pressure production and recovery of liquids, further comprising:

lengthening the liquid injector's outside jacket, screen and liquid responsive vertical float, wherein said float is substantially extended in cylinder length, for adding float opening weight with increased float is substantially extended in cylinder length, for adding float opening weight with increased float closing buoyancy, for opening and closing said injector's double shutoff valve's pilot valve at all variable high operating gaseous hydrocarbon recovery pressure differentials between the wellbore annulus and the production tubing string, for accelerated volume recovery of liquids.

13. The method as defined in claim 8, further comprising:

providing the vertical wellbore annulus with a horizontal wellbore opened into the natural gas formation, said horizontal wellbore exposed to the natural gas formations' in place natural gas and liquid hydrocarbons when said liquid hydrocarbons' level is high in the natural gas formation, for increased exposure area to the in place natural gas and said liquid hydrocarbons for increased volume area recovery of said natural gas and said liquid hydrocarbons.

14. A method for increasing crude oil recovery by a miscible gas injection procedure directly into a downhole liquid hydrocarbon formation, the method comprising:

providing a vertical wellbore annulus with an opened liquid hydrocarbon formation, said opened liquid hydrocarbon formation having an open gas cap and containing in place crude oil and natural gas respectively;

providing a production tubing string from a surface wellhead down the vertical wellbore with a liquid injector on the bottom of said production tubing string, the liquid injector for preventing gases from passing into the production tubing string, said liquid injector for producing formation liquid inflow by vertical wellbore to production tubing pressure differential, after the gas injection period;

providing a surface compressor for miscible gas injection into the open liquid hydrocarbon formation;

providing a surface wellhead casing annulus with a pressure control valve and a pressure gauge for passing gas and controlling a selected wellbore to open liquid hydrocarbon formation recovery pressure after the miscible gas injection procedure is ended;

compressing a miscible gas from the surface compressor through the surface wellhead pressure control valve thereof down the open casing wellbore annulus into a programmed area of the open liquid hydrocarbon formation to contact and enter solution with the in place crude oil, under a selected optimal pressure;

establishing desired crude oil solution gas saturation, viscosity reduction, increased fluidity and mobility, by the surface compressor's miscible gas injection, thereby increasing the crude oil's expulsive force and mobility, through the selected optimal pressure miscible gas going into solution with the crude oil, to be produced and recovered under a maintained predetermined pressure over the crude oil's critical bubble point pressure level; and maintaining the opened liquid hydrocarbon formation under a controlled predetermined pressure with said surface compressor's gas injection forward through the entire miscible gas injection procedure.

15. The method as defined in claim 14, wherein the miscible gas injection procedure thereof is converted for producing and recovering solution gas saturated crude oil, and any other liquids after said miscible gas injection procedure is completed in a programmed area, further comprising:

ceasing said miscible gas injection from the surface compressor into the liquid hydrocarbon formation's in place crude oil after programmed solution gas saturation is completed to allow maximum solution gas saturated crude oil inflow into the vertical wellbore annulus and into said liquid injector;

providing said liquid injector for injecting the solution gas saturated crude oil into the production tubing by wellbore to tubing pressure differential for efficient production and recovery of solution gas saturated crude oil and any possible accompanying condensate;

providing the surface pressure control valve and pressure gauge for maintaining the opened liquid hydrocarbon formation under a selected optimal crude oil recovery pressure over the crude oil's critical bubble point pressure, thereby establishing the liquid hydrocarbon recovery period;

producing the opened liquid hydrocarbon formation liquid inflow through said liquid injector into the production tubing string completely on to the surface by wellbore annulus to production tubing string pressure differential alone; and maintaining the opened liquid hydrocarbon formation under a controlled optimum wellbore annulus to liquid hydrocarbon formation pressure above that of the in place critical crude oil's bubble point pressure, with the surface wellhead pressure control valve thereof, forward through the entire liquid hydrocarbon production and recovery process.

16. The method as defined in claim 14, wherein the wellbore annulus to production tubing string pressure differential through the liquid injector alone cannot lift incoming liquids completely to the surface, and artificial lift is added, further comprising:

providing one or more gas lift valves optimally spaced up hole on the production tubing string above said liquid injector to help lift liquids to the surface, said gas lift valves for selectively injecting wellbore annulus gasses into the production tubing string for lifting columns of incoming liquids through the production tubing string to the surface;

providing a plunger catcher on the surface wellhead, and a plunger lift on a plunger stop directly above the bottom gas lift valve inside the production tubing string for creating a more efficient gas to liquid interface and sweeping action when the bottom gas lift valve opens, by providing a solid piston plunger to help lift the incoming liquids on the to the surface; and removing said plunger by catching it inside the surface wellhead plunger catcher when incoming liquid volume into the tubing string surpasses its ability to travel up and down, and returning to the gas lift valve operation to assist the liquid injector's pressure differential liquid lift by helping stage gas flow the incoming high volume of liquids on to the surface, whereby, assisting said liquid injector's pressure differential liquid lift up through the production tubing string toward the surface.

17. The method as defined in claim 15, wherein the method of recovering solution gas saturated crude oil and any other liquids inflow through the liquid injector into the production tubing string by wellbore annulus to production tubing string pressure differential is improved and substantially enhanced to provide total in place liquid hydrocarbon recovery, further comprising:

injecting water down structure into the liquid hydrocarbon formation as a means for increasing pressure within the liquid hydrocarbon formation, by means for compressing the up structure in place liquid hydrocarbons, whereby creating a selected higher optimal pressure on said in place liquid hydrocarbons for pressurized enhanced recovery of said in place liquid hydrocarbons, thereby obtaining total in place liquid hydrocarbon recovery.

18. The method as defined in claim 14, wherein the liquid injector tool is improved for exceptionally high pressure and higher volume production and recovery of liquids, further comprising:

lengthening the liquid injector's outside jacket, sand screen and liquid responsive vertical float, wherein said float is substantially extended in cylinder length, for adding float opening weight with increased float closing buoyancy, for opening and closing said injector's double shutoff valve at all variable high operating recovery pressure differentials between the wellbore annulus and the production tubing string, for increased volume recovery of liquid hydrocarbons.

19. A method for increasing crude oil recovery by a miscible gas injection procedure drawing natural gas from a downhole liquid hydrocarbon formation's own gas cap, the method comprising:

providing a vertical wellbore annulus with an opened liquid hydrocarbon formation, said opened liquid hydrocarbon formation having an open gas cap and containing in place crude oil and natural gas respectively;

providing a surface compressor for drawing natural gas off the liquid hydrocarbon formation's own gas cap and for reinjection of sad natural gas as a select miscible gas down into the liquid hydrocarbon formation, and for injecting an outside source of miscible gas when gas cap gas is lacking required availability;

providing a production tubing string from a surface wellhead down the vertical wellbore with one or more predetermined spaced dummy plugged gas lift valves on mandrels, and with a wire line operated open sliding sleeve by the open liquid hydrocarbon formation, and with a liquid injector on the bottom of said production tubing string, the liquid injector for preventing gasses from passing into the production tubing string, said liquid injector for producing formation liquid inflow by vertical wellbore to production tubing pressure differential, after the gas injection period;

providing the surface wellhead with a pressure control valve and a pressure gauge for passing gas cap gas into the surface compressor and later on controlling a selected optimum wellbore annulus to open liquid hydrocarbon formation liquid hydrocarbon recovery pressure;

providing a packer on said production tubing string with an dummy plugged gas lift valve on a mandrel below it, said packer separating the open liquid hydrocarbon formation from its upper open gas cap in the vertical tubing to casing wellbore annulus;

drawing natural gas off the opened liquid hydrocarbon formation's gas cap above the packer, and up the vertical wellbore annulus through the wellhead pressure control valve thereof, and into the surface compressor and reinjecting said natural gas at a selected optimal pressure from the surface compressor down the tubing string and out the open sliding sleeve directly into the opened liquid hydrocarbon formation containing in place crude oil below the packer;

compressing said natural gas into a programmed area of the liquid hydrocarbon formation to contact and enter solution with the in place crude oil, as the liquid hydrocarbon formation's own compatible miscible gas under said selected optimal pressure;

establishing desired crude oil solution gas saturation, viscosity reduction, increased fluidity and mobility, by the surface compressor's natural gas injection, thereby increasing the crude oil's expulsive force and mobility through the selected optimal pressure miscible gas going into solution with the crude oil, to be produced and recovered under a maintained predetermined pressure over the crude oil's critical bubble point pressure level; and maintaining the opened liquid hydrocarbon formation under controlled predetermined pressures with said surface compressor gas injection forward through the entire miscible gas injection procedure.

20. The method as defined in claim 19, wherein the miscible gas injection procedure thereof is converted for producing and recovering solution gas saturated crude oil, after said miscible gas injection procedure is completed in a programmed area, further comprising:

ceasing said miscible gas injection from the surface compressor into the liquid hydrocarbon formation's in place crude oil after programmed solution gas saturation is completed and closing the sliding sleeve on the production tubing string to allow maximum crude oil and any other liquids inflow into said vertical wellbore annulus and into the liquid injector;

removing the dummy plugged gas lift valve from its mandrel below the packer with a wire line and installing a real casing pressure operated gas lift valve, providing a gas vent assembly below said packer to maintain an selected optimum pressure in the lower wellbore annulus above the crude oil's critical bubble point pressure level;

providing said liquid injector for injecting liquids into the production tubing by vertical wellbore to tubing pressure differential, for efficient production and recovery of crude oil and any other liquids on to the surface;

producing the opened liquid hydrocarbon formation liquid inflow through said liquid injector into the production tubing string completely on to the surface by vertical wellbore annulus to production tubing string pressure differential alone; and maintaining the opened liquid hydrocarbon formation under controlled optimum wellbore annulus to liquid hydrocarbon formation pressures above that of the in place critical crude oil's bubble point pressure with the packer and the gas vent assembly thereof, forward through the liquid hydrocarbon production and recovery process.

21. The method as defined in claim 20, wherein the packer and gas vent assembly are removed so that full surface control of the vertical wellbore annulus to the open liquid hydrocarbon formation may be attained, further comprising;

providing the surface wellhead's pressure control valve and the pressure gauge thereof, for controlling a selected optimum wellbore annulus to open liquid hydrocarbon formation liquid hydrocarbon recovery pressure;

producing the opened liquid hydrocarbon formation liquid inflow through said liquid injector into the production tubing string completely on to the surface by wellbore annulus to production tubing string pressure differential alone; and maintaining the opened liquid hydrocarbon formation under controlled optimum wellbore annulus to liquid hydrocarbon formation pressures above that of the in place crude oil's bubble point pressure, with the surface wellhead pressure control valve thereof, forward through the entire liquid hydrocarbon production and recovery process.

22. The method as defined in claim 20, wherein the wellbore annulus to production tubing string pressure differential through the liquid injector alone cannot lift incoming liquids completely to the surface, and artificial lift is added, further comprising:

removing the one or more predetermined spaced dummy plugged gas lift valves on mandrels and providing one or more gas lift valves optimally spaced up hole on the production tubing string above said liquid injector to help lift liquids to the surface, said gas lift valves for selectively injecting wellbore annulus gasses into the production tubing string for lifting columns of incoming liquids through the production tubing string to the surface;

providing a plunger catcher on the surface wellhead, and a plunger lift on a plunger stop directly above the bottom gas lift valve inside the production tubing string for creating a more efficient gas to liquid interface and sweeping action when the bottom gas lift valve opens, by providing a solid piston plunger to help lift the incoming liquids on to the surface;

removing said plunger by catching it inside the surface wellhead plunger catcher when incoming liquid volume into the tubing string surpasses its ability to travel up and down, and returning to the gas lift valve operation to assist the liquid injector's pressure differential liquid lift by helping stage gas flow the incoming high volume of liquids on to the surface, whereby, assisting said liquid injector's pressure differential liquid lift up through the production tubing string toward the surface; and recovering the opened liquid hydrocarbon formation liquid inflow through said liquid injector into the production tubing string on to the surface by wellbore annulus to production tubing string pressure differential and artificial lift assist, thereby producing the incoming high volume of liquids on to the surface.

23. The method as defined in claim 20, wherein the method of recovering solution gas saturated crude oil liquid inflow production through the liquid injector into the production tubing string by wellbore annulus to production tubing string pressure differential is improved and substantially enhanced to provide total in place liquid hydrocarbon recovery, further comprising:

injecting water down structure into the liquid hydrocarbon formation as a means for increasing pressure within the liquid hydrocarbon formation, by means of compressing the up structure in place liquid hydrocarbons, whereby creating a selected higher optimal pressure on said in place liquid hydrocarbons for pressurized enhanced recovery of said in place liquid hydrocarbons, thereby obtaining total in place liquid hydrocarbon recovery.

24. The method as defined in claim 19, wherein the liquid injector tool is improved for exceptionally high pressure and increased volume production and recovery of liquids, further comprising:

lengthening the liquid injector's outside jacket, screen and liquid responsive vertical float, wherein said float is substantially extended in cylinder length, for adding float opening weight with increased float closing buoyancy, for opening and closing said injector's double shutoff valve at all variable high operating recovery pressure differentials between the wellbore annulus and the production tubing string, for increased volume recovery of liquid hydrocarbons.

* * * * *